US009520651B2

(12) United States Patent
Astakhov et al.

(10) Patent No.: US 9,520,651 B2
(45) Date of Patent: Dec. 13, 2016

(54) GLOBAL NAVIGATION SATELLITE SYSTEM ANTENNA WITH A HOLLOW CORE

(71) Applicant: LLC "Topcon Positioning Systems", Moscow (RU)

(72) Inventors: Andrey Vitalievich Astakhov, Moscow (RU); Dmitry Vitalievich Tatarnikov, Moscow (RU); Pavel Petrovich Shamatulsky, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 0 days.

(21) Appl. No.: 14/772,281

(22) PCT Filed: Jan. 16, 2014

(86) PCT No.: PCT/RU2014/000021

§ 371 (c)(1),
(2) Date: Sep. 2, 2015

(87) PCT Pub. No.: WO2015/108436

PCT Pub. Date: Jul. 23, 2015

(65) Prior Publication Data

US 2016/0020521 A1 Jan. 21, 2016

(51) Int. Cl.
*H01Q 13/10* (2006.01)
*H01Q 1/48* (2006.01)
(Continued)

(52) U.S. Cl.
CPC ..... *H01Q 13/10* (2013.01); *H01Q 1/48* (2013.01); *H01Q 9/0414* (2013.01); *H01Q 9/0428* (2013.01); *H01Q 21/30* (2013.01)

(58) Field of Classification Search
CPC ..... H01Q 9/0414; H01Q 9/0428
See application file for complete search history.

(56) References Cited

U.S. PATENT DOCUMENTS 5,220,334 A 6/1993 Raguenet et al.
7,126,538 B2 10/2006 Sampo
(Continued)

FOREIGN PATENT DOCUMENTS

RU 2134923 C1 8/1999
RU 2258284 C1 8/2005

OTHER PUBLICATIONS

International Search Report and Written Opinion mailed Feb. 5, 2015, in connection with International Patent Application No. PCT/RU2014/000021, 6 pgs.

*Primary Examiner* — Sue A Purvis
*Assistant Examiner* — Daniel J Munoz
(74) *Attorney, Agent, or Firm* — Chiesa Shahinian & Giantomasi PC

(57) ABSTRACT

Disclosed is a dual-band Global Navigation Satellite System antenna with a hollow core. The antenna includes a conductive cylindrical tube with a longitudinal axis. A ground plane, a low-frequency radiator, and a high-frequency radiator are annuli orthogonal to the longitudinal axis. The inner peripheries of the ground plane and the low-frequency radiator are electrically connected to the outer surface of the cylindrical tube. The outer periphery of the high-frequency radiator is electrically connected to the low-frequency radiator. A vertical low-frequency radiating gap is configured between the ground plane and the outer periphery of the low-frequency radiator. A horizontal high-frequency radiating gap is configured between the inner periphery of the high-frequency radiator and the outer surface of the cylindrical tube. In an embodiment, the inner diameter of the cylindrical tube has a value from about 27 mm to about 102 mm, permitting insertion of a post or pole.

14 Claims, 27 Drawing Sheets

(51) Int. Cl.
*H01Q 9/04* (2006.01)
*H01Q 21/30* (2006.01)

(56) References Cited

U.S. PATENT DOCUMENTS

2002/0171595 A1* 11/2002 Schultze ..... H01Q 9/0414
343/770
2008/0218418 A1* 9/2008 Gillette ..... H01Q 1/38
343/700 MS
2014/0176386 A1* 6/2014 Rentz ..... H01Q 1/50
343/836

* cited by examiner

VIEW B
400
203
+x
X'
X
+y
205
404
420-12
408
420
445
447
453-2
416-2
420-2
420O
420-1
420I
406
451-2
460-1
460
412
401
402
460O
467
465
460-5
420-7
461
403
405
407
409
411
413

VIEW PX 504
203
+x
524O
552
205
+y
524I
VIEW B
524T
552-J

504

FIG. 5L
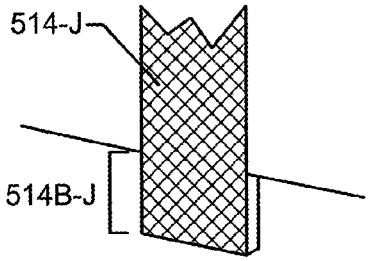
FIG. 5M
FIG. 5K
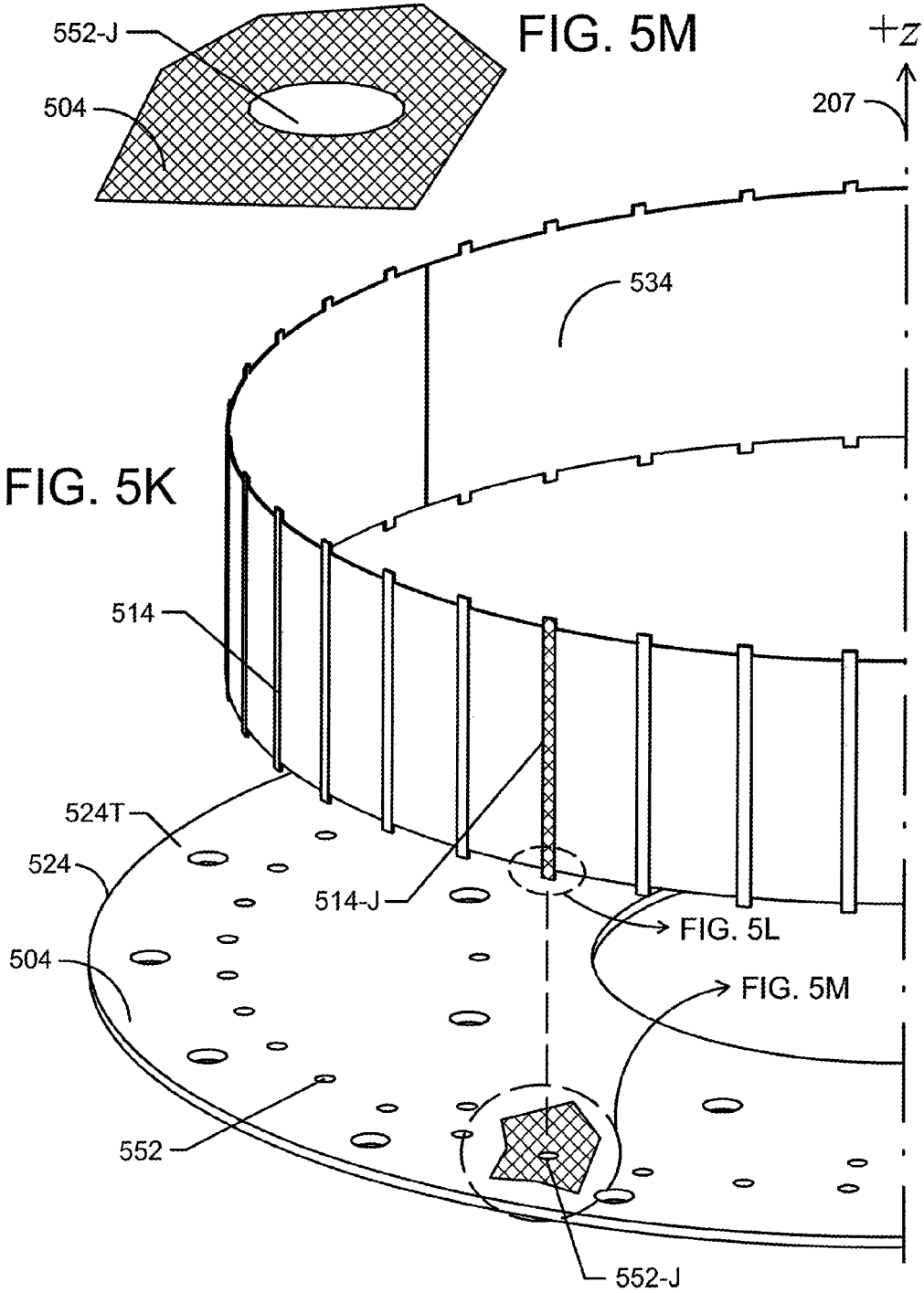

VIEW X-X'

VIEW X-X'

GLOBAL NAVIGATION SATELLITE SYSTEM ANTENNA WITH A HOLLOW CORE

CROSS-REFERNCE TO RELATED APPLICATIONS

This application is a national stage (under 35 U.S.C. 371) of International Patent Application No. PCT/RU2014/000021, filed Jan. 16, 2015, which is herein incorporated by reference in its entirety.

BACKGROUND OF THE INVENTION

The present invention relates generally to antennas, and more particularly to antennas for global navigation satellite systems.

Global navigation satellite systems (GNSSs) can determine positions with high accuracy. In a GNSS, a GNSS antenna receives electromagnetic signals transmitted from a constellation of GNSS satellites located within a line-of-sight of the antenna. The received electromagnetic signals are then processed by a GNSS receiver to determine the precise position of the GNSS antenna.

BRIEF SUMMARY OF THE INVENTION

In an embodiment, an antenna includes a conductive cylindrical tube, a ground plane, a low-frequency radiator, and a high-frequency radiator. The conductive cylindrical tube has a longitudinal axis, an inner surface with a first inner diameter, and an outer surface with a first outer diameter. The ground plane has the geometry of a first annulus, in which the first circular inner periphery has a second inner diameter, and the first circular outer periphery has a second outer diameter. The ground plane is orthogonal to the longitudinal axis, and the first circular inner periphery is electrically connected to the outer surface of the conductive cylindrical tube.

The low-frequency radiator has the geometry of a second annulus, in which the second circular inner periphery has a third inner diameter, and the second circular outer periphery has a third outer diameter. The low-frequency radiator is orthogonal to the longitudinal axis, and the second circular inner periphery is electrically connected to the outer surface of the conductive cylindrical tube. The low-frequency radiator is spaced apart from the ground plane, and a low-frequency radiating gap is configured between the second circular outer periphery and the ground plane.

The high-frequency radiator has the geometry of a third annulus, in which the third circular inner periphery has a fourth inner diameter, and the third circular outer periphery has a fourth outer diameter. The high-frequency radiator is orthogonal to the longitudinal axis, and the high-frequency radiator is spaced apart from the low-frequency radiator such that the low-frequency radiator is disposed between the high-frequency radiator and the ground plane. The third circular outer periphery is electrically connected to the low-frequency radiator, and a high-frequency radiating gap is configured between the third circular inner periphery and the outer surface of the conductive cylindrical tube.

In an embodiment, the outer diameter of the conductive cylindrical tube has a value from about 28 mm to about 103 mm, and the inner diameter of the conductive cylindrical tube has a value from about 27 mm to about 102 mm. This range of inner diameters is sufficient to permit a post or pole to be inserted into the cylindrical tube.

These and other advantages of the invention will be apparent to those of ordinary skill in the art by reference to the following detailed description and the accompanying drawings.

DETAILED DESCRIPTION

Figure 1:
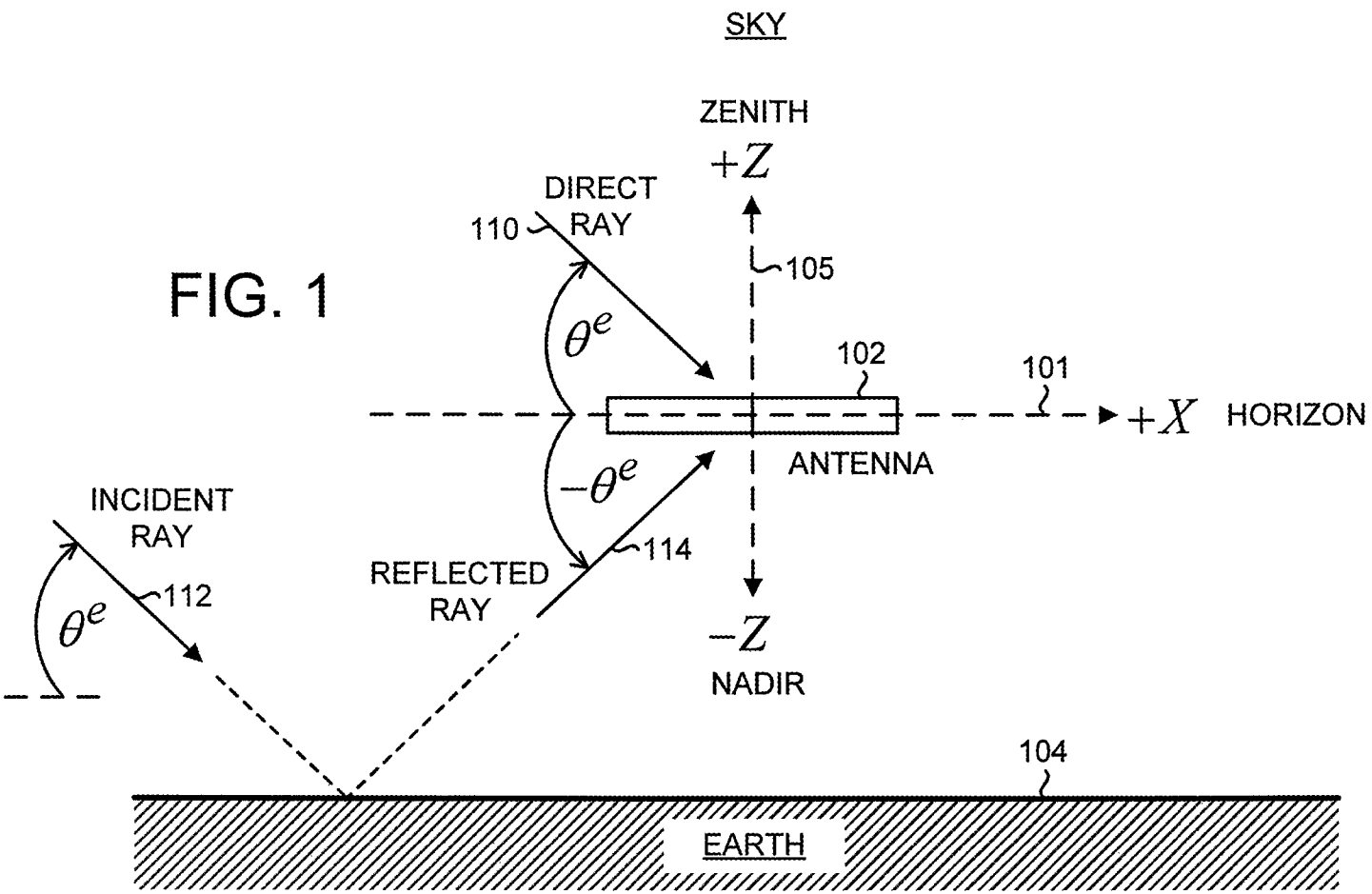
FIG. 1 shows a schematic of the direct signal region and the multipath signal region.

FIG. 1 shows a schematic of a global navigation satellite system (GNSS) antenna 102 positioned above the Earth 104. Herein, the term Earth includes both land and water environments. To avoid confusion with "electrical" ground (as used in reference to a ground plane), "geographical" ground (as used in reference to land) is not used herein. To simplify the drawing, supporting structures for the antenna are not shown. Shown is a reference Cartesian coordinate system with X-axis 101 and Z-axis 105. The Y-axis (not shown) points into the plane of the figure. In an open-air environment, the +Z (up) direction, referred to as the zenith, points towards the sky, and the −Z (down) direction, referred to as the nadir, points towards the Earth. The X-Y plane lies along the local horizon plane.

In FIG. 1, electromagnetic waves (carrying electromagnetic signals) are represented by rays with an elevation angle $\theta^e$ with respect to the horizon. The horizon corresponds to $\theta^e=0$ deg; the zenith corresponds to $\theta^e=+90$ deg; and the nadir corresponds to $\theta^e=-90$ deg. Rays incident from the open sky, such as ray 110 and ray 112, have positive values of elevation angle. Rays reflected from the Earth 104, such as ray 114, have negative values of elevation angle. Herein, the region of space with positive values of elevation angle is referred to as the direct signal region and is also referred to as the forward (or top) hemisphere. Herein, the region of space with negative values of elevation angle is referred to as the multipath signal region and is also referred to as the backward (or bottom) hemisphere. Ray 110 impinges directly on the antenna 102 and is referred to as the direct ray 110; the angle of incidence of the direct ray 110 with respect to the horizon is $\theta^e$. Ray 112 impinges directly on the Earth 104; the angle of incidence of the ray 112 with respect to the horizon is $\theta^e$. Assume ray 112 is specularly reflected. Ray 114, referred to as the reflected ray 114, impinges on the antenna 102; the angle of incidence of the reflected ray 114 with respect to the horizon is $-\theta^e$.

To numerically characterize the capability of an antenna to mitigate the reflected signal, the following ratio is commonly used:

$$DU(\theta^e) = \frac{F(-\theta^e)}{F(\theta^e)}. \tag{E1}$$

The parameter $DU(\theta^e)$ (down/up ratio) is equal to the ratio of the antenna pattern level $F(-\theta^e)$ in the backward hemisphere to the antenna pattern level $F(\theta^e)$ in the forward hemisphere at the mirror angle, where F represents a voltage level. Expressed in dB, the ratio is:

$$DU(\theta^e)\ \text{dB}=20\ \log DU(\theta^e). \tag{E2}$$

A commonly used characteristic parameter is the down/up ratio at $\theta^e$=+90 deg:

$$DU_{90} = DU(\theta^e = 90°) = \frac{F(-90°)}{F(90°)}. \tag{E3}$$

In a GNSS, the accuracy of position determination is improved as the antenna receives signals from a larger constellation of satellites; in particular, from low-elevation satellites (~10- 15 deg above the horizon). A strong antenna pattern level over nearly the entire forward hemisphere is therefore desirable.

A major source of errors uncorrected by signal processing is multipath reception by the receiving antenna. In addition to receiving direct signals from the satellites, the antenna receives signals reflected from the environment around the antenna. The reflected signals are processed along with the direct signals and cause errors in time delay measurements and errors in carrier phase measurements. These errors subsequently cause errors in position determination. An antenna that strongly suppresses the reception of multipath signals is therefore desirable.

Each navigation satellite in a GNSS can transmit circularly-polarized signals on one or more frequency bands (for example, on the L1, L2, and L5 frequency bands). A single-band navigation receiver receives and processes signals on one frequency band (such as L1); a dual-band navigation receiver receives and processes signals on two frequency bands (such as L1 and L2); and a multi-band navigation receiver receives and processes signals on three or more frequency bands (such as L1, L2, and L5). A single-system navigation receiver receives and processes signals from a single GNSS [such as the US Global Positioning System (GPS)]; a dual-system navigation receiver receives and processes signals from two GNSSs (such as GPS and the Russian GLONASS); and a multi-system navigation receiver receives and processes signals from three or more systems (such as GPS, GLONASS, and the planned European GALILEO). The operational frequency bands can be different for different systems. An antenna that receives signals over the full frequency range assigned to GNSSs is therefore desirable. The full frequency range assigned to GNSSs is divided into two frequency bands: the low-frequency band (about 1165 to about 1300 MHz) and the high-frequency band (about 1525 to about 1605 MHz).

For portable navigation receivers, compact size and light weight are important design factors. Low-cost manufacture is usually an important factor for commercial products. For a GNSS navigation receiver, therefore, an antenna with the following design factors would be desirable: circular polarization; operating frequency over the low-frequency band (about 1165 to about 1300 MHz) and the high-frequency band (about 1525 to about 1605 MHz); strong antenna pattern level over most of the forward hemisphere; strong suppression of multipath signals; compact size; light weight; and low manufacturing cost.

In some applications, the antenna is mounted on a short post or on a long pole. In some instances, the antenna is mounted slightly above, but not in direct contact with, a surface, which can be planar (flat) or curved. In these instances, the antenna can be mounted to a short post, which in turn is mounted to the surface. In other instances, the antenna is mounted to a long pole; for example, the long pole can be a surveying pole or a mast on a vehicle. In an advantageous design, the antenna has an internal clear space (hollow core) through which the post or pole can be inserted. This configuration simplifies mounting of the antenna to the post or pole and allows a wide range of spacing between the antenna and a support surface; furthermore, the spacing can be readily adjusted by sliding the antenna along the post or pole.

In embodiments of antenna systems described herein, geometrical conditions are satisfied if they are satisfied within specified tolerances; that is, ideal mathematical conditions are not implied. The tolerances are specified, for example, by an antenna engineer. The tolerances are specified depending on various factors, such as available manufacturing tolerances and trade-offs between performance and cost. As examples, two lengths are equal if they are equal to within a specified tolerance, two planes are parallel if they are parallel within a specified tolerance, and two lines are orthogonal if the angle between them is equal to 90 deg within a specified tolerance. Similarly, geometrical shapes such as circles and cylinders have associated "out-of-round" tolerances.

For GNSS receivers, the antenna is operated in the receive mode (receive electromagnetic radiation or signals). Following standard antenna engineering practice, however, antenna performance characteristics are specified in the transmit mode (transmit electromagnetic radiation or signals). This practice is well accepted because, according to the well-known antenna reciprocity theorem, antenna performance characteristics in the receive mode correspond to antenna performance characteristics in the transmit mode.

Figure 2:
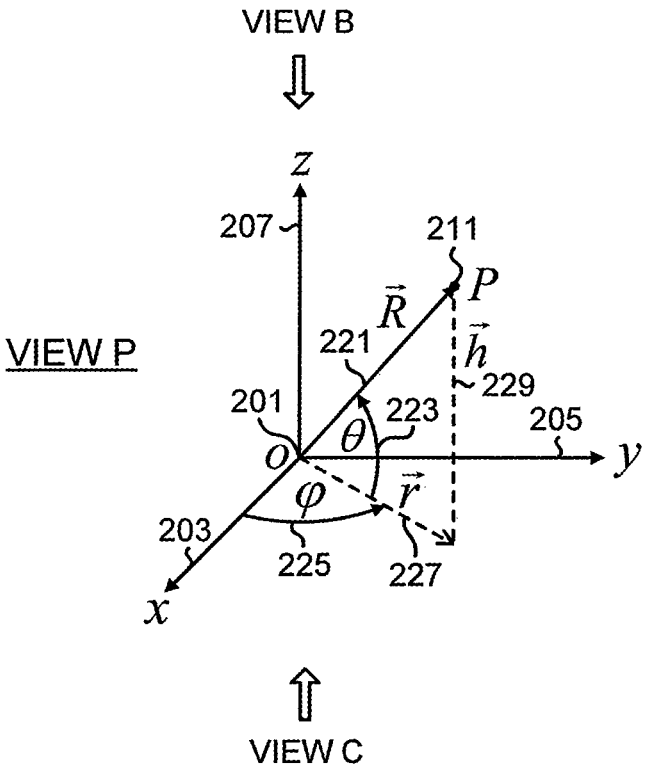
FIG. 2 shows a schematic of an antenna reference coordinate system.

The geometry of antenna systems is described with respect to the Cartesian coordinate system shown in FIG. 2 (View P, perspective view). The Cartesian coordinate system has origin O 201, x-axis 203, y-axis 205, and z-axis 207. The coordinates of the point P 211 are then P(x,y,z). Let $\vec{R}$ 221 represent the vector from O to P. The vector $\vec{R}$ can be decomposed into the vector $\vec{r}$ 227 and the vector $\vec{h}$ 229, where $\vec{r}$ the projection of $\vec{R}$ onto the x-y plane, and $\vec{h}$ is the projection of $\vec{R}$ onto the z-axis.

The coordinates of P can also be expressed in the spherical coordinate system and in the cylindrical coordinate system. In the spherical coordinate system, the coordinates of P are $P(R,\theta,\phi)$, where $R=|\vec{R}|$ is the radius, $\theta$ 223 is the polar angle measured from the x-y plane, and $\phi$ 225 is the azimuthal angle measured from the x-axis. In the cylindrical coordinate system, the coordinates of P are $P(r,\phi,h)$, where $r=|\vec{r}|$ is the radius, $\phi$ is the azimuthal angle, and $h=|\vec{h}|$ is the height measured parallel to the z-axis. In the cylindrical coordinate axis, the z-axis is referred to as the longitudinal axis. In geometrical configurations that are azimuthally symmetric about the z-axis, the z-axis is referred to as the longitudinal axis of symmetry, or simply the axis of symmetry if there is no other axis of symmetry under discussion.

The polar angle θ is more commonly measured down from the +z-axis ($0 \leq \theta \leq \pi$). Here, the polar angle θ 223 is measured from the x-y plane for the following reason. If the z-axis 207 refers to the z-axis of an antenna system, and the z-axis 207 is aligned with the geographic z-axis 105 in FIG. 1, then the polar angle θ 223 will correspond to the elevation angle $\theta^e$ in FIG. 1; that is, $-90° \leq \theta \leq +90°$, where $\theta=0°$ corresponds to the horizon, $\theta=+90°$ corresponds to the zenith, and $\theta=-90°$ corresponds to the nadir.

In illustrating embodiments of antennas, various views are used in the figures. View B is a top (plan) view, sighted along the −z-axis. View C is a bottom view, sighted along the +z-axis. Other views are defined as needed.

Figure 3A:
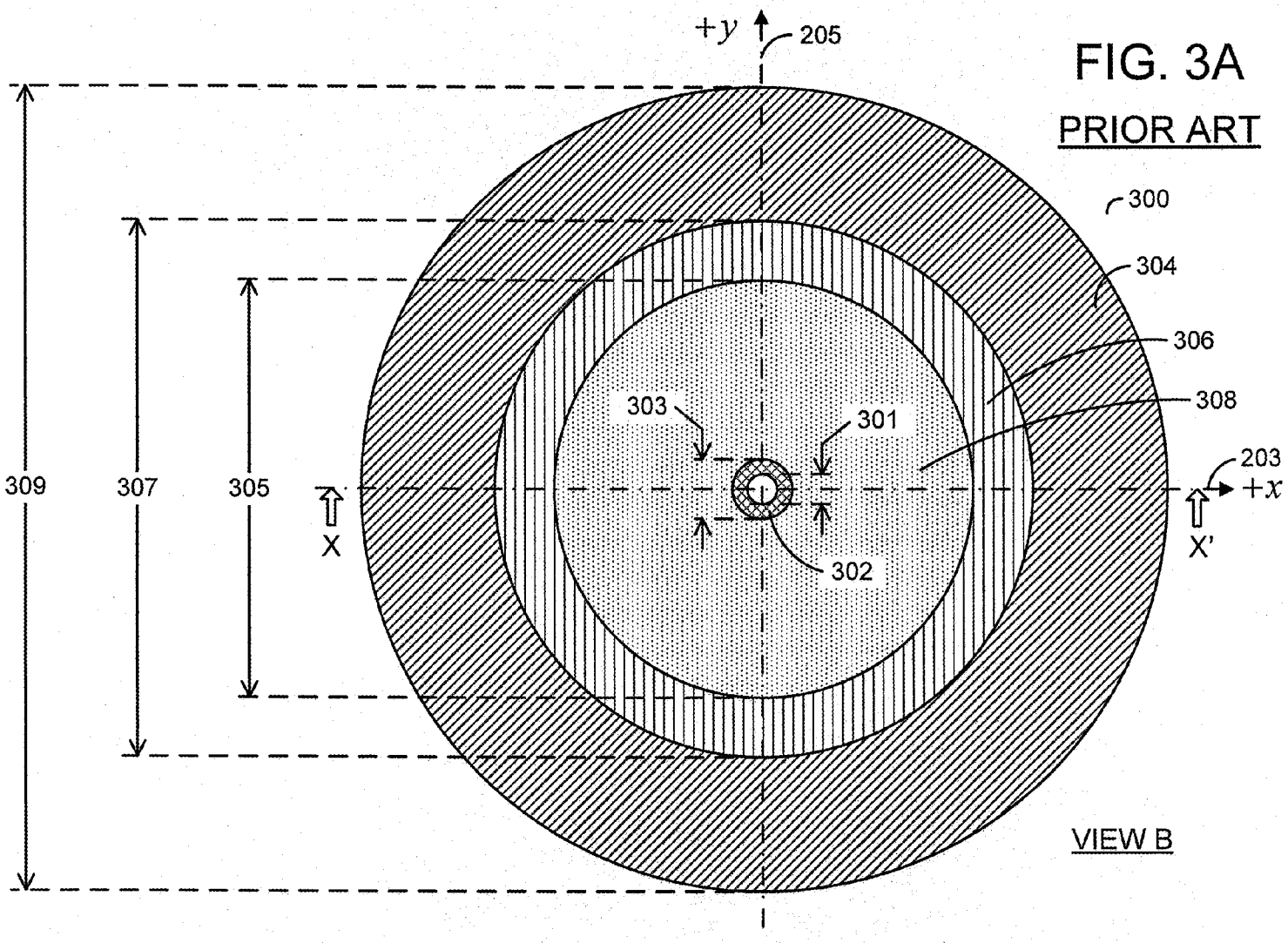
FIG. 3A PRIOR ART
FIG. 3A and FIG. 3B show schematics of a prior-art antenna.
Figure 3B:
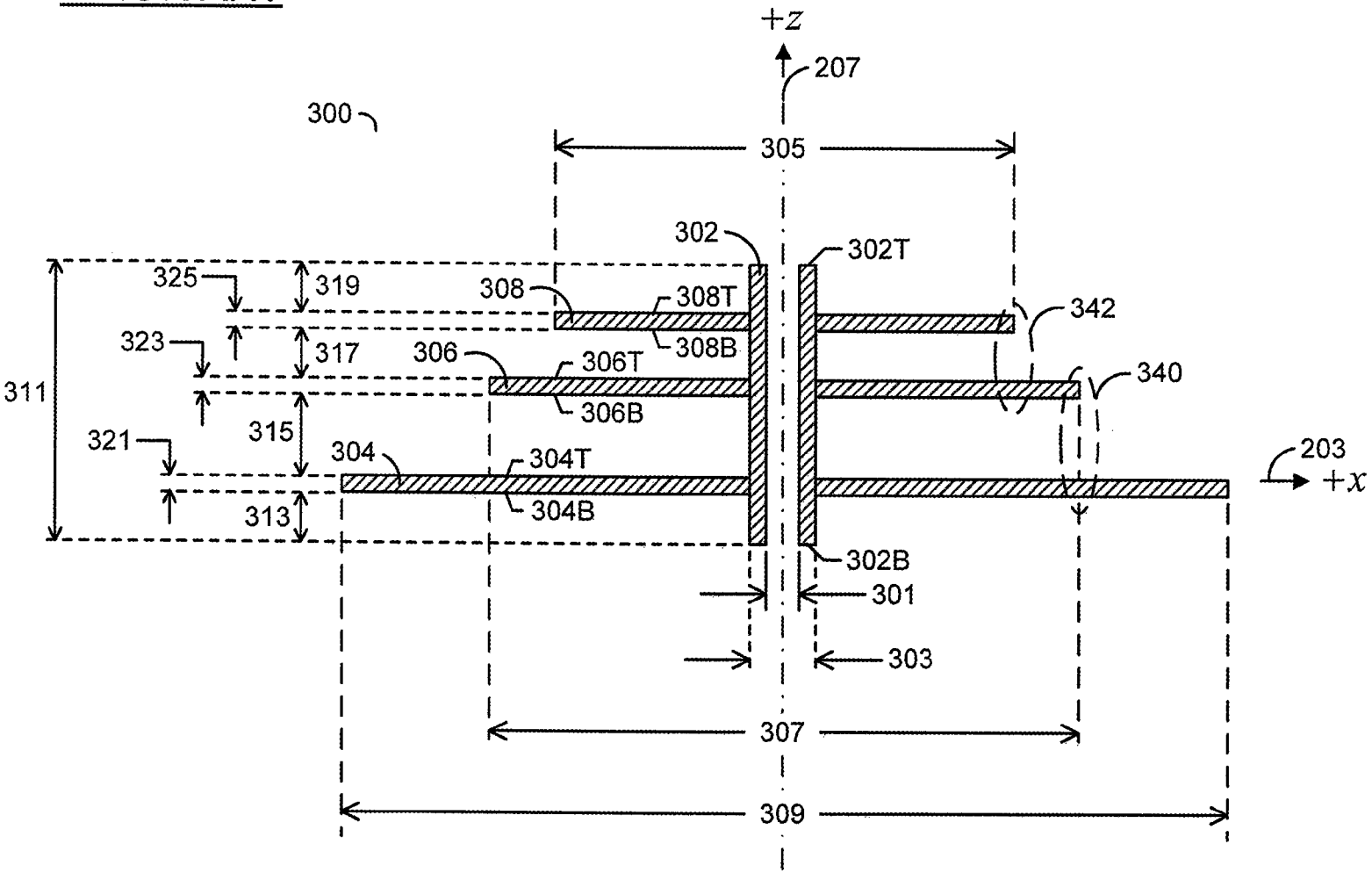
FIG. 3B PRIOR ART

FIG. 3A and FIG. 3B show schematics of a prior-art antenna with a hollow core. FIG. 3A shows View B, and FIG. 3B shows View X-X', a cross-sectional view in the x-z plane. FIG. 3A and FIG. 3B should be viewed together. The prior-art antenna 300 includes a conductive cylindrical tube 302, with a longitudinal axis along the +z-axis; a ground plane 304; a low-frequency (LF) radiator 306; and a high-frequency (HF) radiator 308. The ground plane 304, the LF radiator 306, and the HF radiator 308 are all conductive discs. The plane of each conductive disc is parallel to the x-y plane (orthogonal to the z-axis). At the center of each conductive disc is a hole. The cylindrical tube 302 is inserted into the hole, and the cylindrical tube 302 is electrically connected to the conductive disc; for example, via a solder joint.

In the dimensions described below, diameters are measured along the x-y plane; thicknesses, heights, and vertical spacings (also referred to as longitudinal spacings) are measured along the z-axis. The cylindrical tube 302 has an inner diameter 301, an outer diameter 303, and a height 311 (measured between the bottom end face 302B and the top end face 302T). The ground plane 304 has an outer diameter 309 and a thickness 321 (measured between the bottom surface 304B and the top surface 304T). The LF radiator 306 has an outer diameter 307 and a thickness 323 (measured between the bottom surface 306B and the top surface 306T). The HF radiator 308 has an outer diameter 305 and a thickness 325 (measured between the bottom surface 308B and the top surface 308T).

The vertical spacing between the bottom end face 302B of the cylindrical tube 302 and the bottom surface 304B of the ground plane 304 is the vertical spacing 313. The vertical spacing between the top surface 304T of the ground plane 304 and the bottom surface 306B of the LF radiator 306 is the vertical spacing 315. The vertical spacing between the top surface 306T of the LF radiator 306 and the bottom surface 308B of the HF radiator 308 is the vertical spacing 317. The vertical spacing between the top surface 308T of the HF radiator 308 and the top end face 302T of the cylindrical tube 302 is the vertical spacing 319.

In the prior-art antenna 300, the maximum value of the outer diameter 303 of the cylindrical tube 302 is 0.05λ, where λ is an operational wavelength of the antenna (the choice of λ is discussed in more detail below). Assuming that the cylindrical tube 302 has a thin wall [wall thickness of about 0.5 mm, where the wall thickness=(outer diameter 303−inner diameter 301)/2], the inner diameter 301 is equal to the outer diameter 303 (in mm)−1 mm. As discussed in more detail below, at GNSS frequencies, λ ranges from about 258 mm at the low end of the LF band to about 187 mm at the high end of the HF band. For λ=258 mm, 0.05λ corresponds to a value of 13 mm; for a value of λ=187 mm, 0.05λ corresponds to a value of 9 mm; therefore, the inner diameter corresponds to values of 12 mm to 9 mm. For some applications, discussed below, a larger inner diameter, corresponding to an outer diameter 303 in the range from about 0.15λ to about 0.4λ, is desired. In the prior-art antenna 300, if the outer diameter 303 of the cylindrical tube 302 is increased, then, to maintain the desired operational frequency range, the outer diameter 307 of the LF radiator 306 and the outer diameter 305 of the HF radiator 308 needs to be increased.

Increasing the outer diameter 307 and the outer diameter 305, however, degrades the antenna performance. Shown in FIG. 3B are the LF radiating gap 340 (formed between the outer periphery of the LF radiator 306 and the underlying ground plane 304) and the HF radiating gap 342 (formed between the outer periphery of the HF radiator 308 and the underlying LF radiator 306). The antenna pattern level at low elevation angles is known to be determined by the diameter of the radiating gap. In the prior-art antenna 300, the diameter of the LF radiating gap 340 corresponds to the outer diameter 307 of the LF radiator 306, and the diameter of the HF radiating gap 342 corresponds to the outer diameter 305 of the HF radiator 308.

When the diameter of the radiating gap is increased (greater than about 0.4λ), the antenna pattern level at low elevation angles is decreased. As discussed above, a decrease of the antenna pattern level at low elevation angles is undesirable for GNSS antennas. Furthermore, the antenna pattern levels at other angles in the forward hemisphere can also drop, and the degree of multipath suppression decreases (the down/up ratio increases).

Figure 4A:
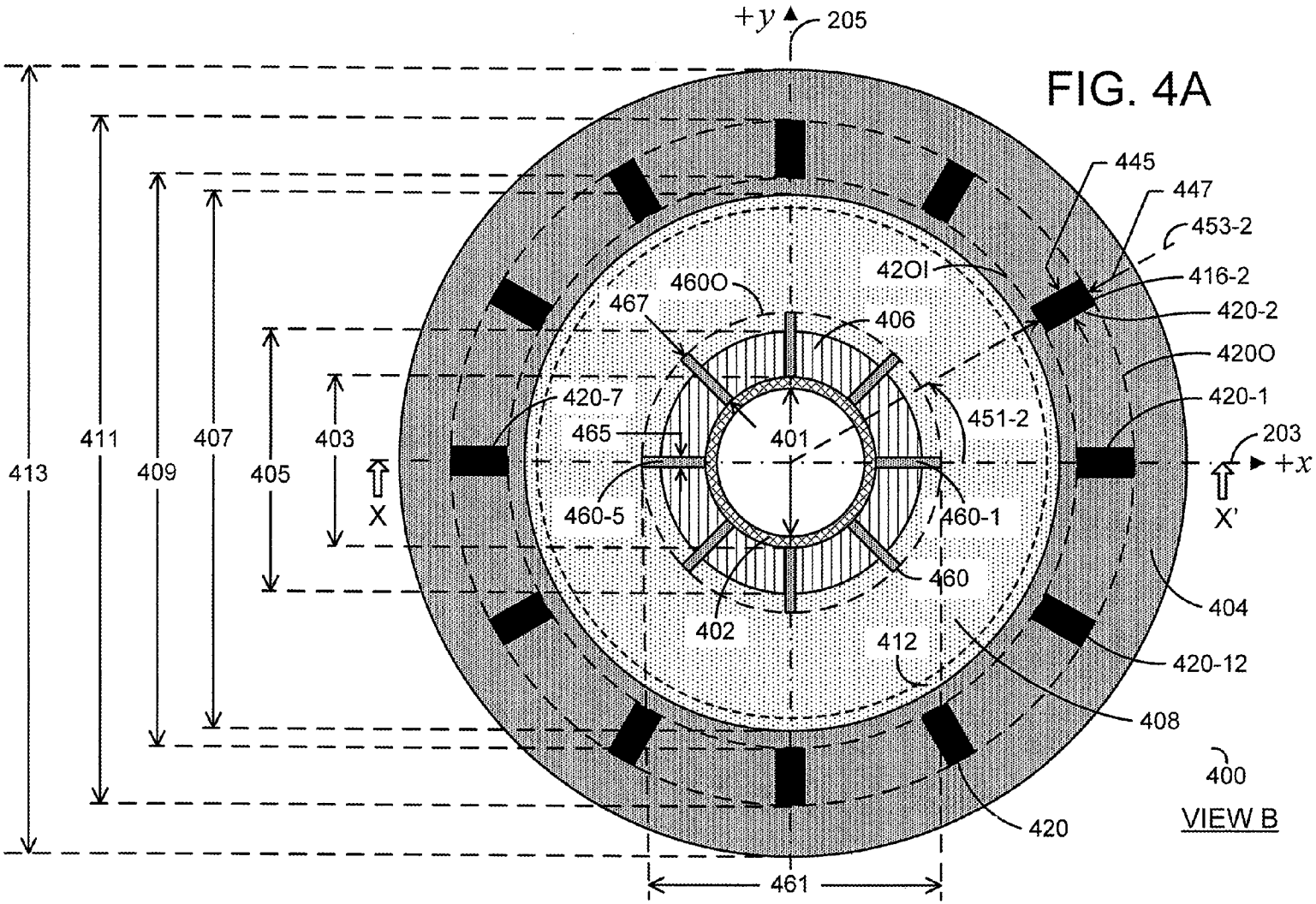
FIG. 4A and FIG. 4B show schematics of an antenna, according to an embodiment of the invention.
Figure 4B:
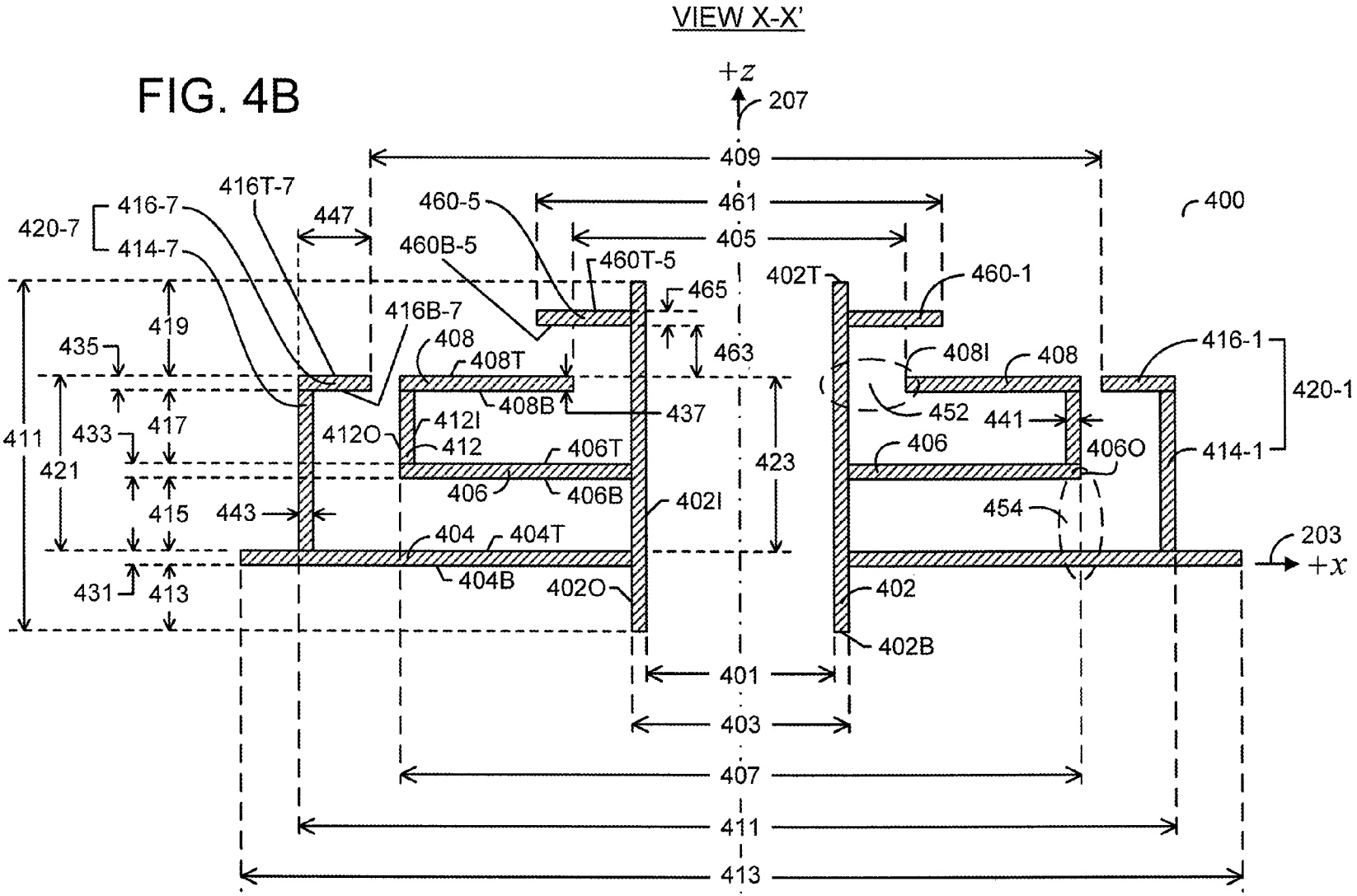

FIG. 4A and FIG. 4B show schematics of an antenna, according to an embodiment of the invention. FIG. 4A shows View B, and FIG. 4B shows View X-X', a cross-sectional view in the x-z plane. FIG. 4A and FIG. 4B should be viewed together. The antenna 400 includes a conductive cylindrical tube 402, with a longitudinal axis along the +z-axis; a ground plane 404; a low-frequency (LF) radiator 406; a high-frequency (HF) radiator 408; and a set of HF capacitive elements 460. The embodiment shown also includes a set of parasitic elements 420; other embodiments do not include a set of parasitic elements. Each of the ground plane 404, the LF radiator 406, and the HF radiator 408 is a conductive disc with a central hole (formally referred to as an annulus). The plane of each conductive disc is parallel to the x-y plane (orthogonal to the z-axis). The cylindrical tube 402 is inserted into the holes, and the cylindrical tube 402 is electrically connected to the ground plane 404 and the LF radiator 406; for example, via solder joints. Details of the HF radiator 408, the set of HF capacitive elements 460, and the set of parasitic elements 420 are described below.

In the dimensions described below, diameters, wall thicknesses, and lengths are measured along the x-y plane; thicknesses, heights, and vertical spacings (also referred to as longitudinal spacings) are measured along the z-axis.

The cylindrical tube 402 has the outer surface (wall) 402O, the inner surface (wall) 402I, the top end face (also referred to as the first end face) 402T, and the bottom end face (also referred to as the second end face) 402B. The plane of the top end face and the plane of the bottom end face are each orthogonal to the longitudinal axis. Each of the inner surface and the outer surface is a cylindrical surface. The cylindrical tube 402 has an inner diameter 401, an outer diameter 403, and a height 411 (measured between the bottom end face 402B and the top end face 402T). In an embodiment, the outer diameter 403 has a value from about $0.15\lambda_{ref}$ to about $0.4\lambda_{ref}$, where $\lambda_{ref}$ is a reference operational wavelength of the antenna (see below).

Wavelength is related to frequency by the well-known relationship $\lambda=c/f$, where $\lambda$ is the wavelength, c is the speed of light, and f is the frequency. In free space, the following values are obtained:

TABLE I

| f (MHz) | λ (mm) | 0.15λ (mm) | 0.4λ (mm) |
|---|---|---|---|
| GNSS LF BAND | | | |
| 1165 | 258 | 39 | 103 |
| 1300 | 231 | 35 | 92 |
| GNSS HF BAND | | | |
| 1525 | 197 | 30 | 79 |
| 1605 | 187 | 28 | 75 |

In some embodiments, the antenna is tuned to operate over a narrower band than the full GNSS band. In general, in the frequency domain, $$f_{LF,min} \le f_{LF} \le f_{LF,max}, \text{ and}$$

$$f_{HF,min} \le f_{HF} \le f_{HF,max};$$

where $f_{LF}$ is an operational frequency of the antenna in the LF band bounded by the minimum value $f_{LF,min}$ and the maximum value $f_{LF,max}$, and $f_{HF}$ is an operational frequency of the antenna in the HF band bounded by the minimum value $f_{HF,min}$ and the maximum value $f_{HF,max}$; the minimum and maximum values are specified, for example, by an antenna designer for the application of interest. Similarly, in the wavelength domain, $$\lambda_{LF,min} \le \lambda_{LF} \le \lambda_{LF,max}, \text{ and}$$

$$\lambda_{HF,min} \le \lambda_{HF} \le \lambda_{HF,max};$$

where $\lambda_{LF}$ is an operational wavelength of the antenna in the LF band bounded by the minimum value $\lambda_{LF,min}$ and the maximum value $\lambda_{LF,max}$, and $\lambda_{HF}$ is an operational wavelength of the antenna in the HF band bounded by the minimum value $\lambda_{HF,min}$ and the maximum value $\lambda_{HF,max}$.

The reference operational wavelength $\lambda_{ref}$ is selected by the antenna designer as a single reference value at which to characterize the operational parameters of the antenna. Examples of $\lambda_{ref}$ include the value of $\lambda$ corresponding to $f_{LF,min}$, the value of $\lambda$ corresponding to the central frequency in the LF band $f_{LF,min} \le f_{LF} \le f_{LF,max}$, and the value of $\lambda$ corresponding to the central frequency over the dual frequency band $f_{LF,min} \le f \le f_{HF,max}$. In some applications, two reference operational wavelengths are defined, one for the LF band ($\lambda_{LF,ref}$) and one for the HF band ($\lambda_{HF,ref}$); in each band, the reference wavelength, for example, can correspond to the minimum frequency, the central frequency, or the maximum frequency in the band.

The ground plane 404 has an outer diameter 413, an inner diameter 403, and a thickness 431 (measured between the bottom surface 404B and the top surface 404T). The LF radiator 406 has an outer diameter 407, an inner diameter 403, and a thickness 433 (measured between the bottom surface 406B and the top surface 406T). The HF radiator 408 has an outer diameter 407, an inner diameter 405, and a thickness 437 (measured between the bottom surface 408B and the top surface 408T). The HF radiator 408 is electrically connected to the LF radiator 406 by the conductive cylindrical tube 412, which has the outer wall 412O and the inner wall 412I; the wall thickness of the cylindrical tube 412 is the wall thickness 441.

The vertical spacing between the bottom end face 402B of the cylindrical tube 402 and the bottom surface 404B of the ground plane 404 is the vertical spacing 413. The vertical spacing between the top surface 404T of the ground plane 404 and the bottom surface 406B of the LF radiator 406 is the vertical spacing 415. The vertical spacing between the top surface 406T of the LF radiator 406 and the bottom surface 408B of the HF radiator 408 is the vertical spacing 417. The vertical spacing between the top surface 408T of the HF radiator 408 and the top end face 402T the cylindrical tube 402 is the vertical spacing 419.

In an embodiment, the vertical spacing 417 (also referred to as the height $h_1$) has a value from about $0.02\lambda_{HF,ref}$ to about $0.1\lambda_{HF,ref}$, where $\lambda_{HF,ref}$ is a reference operational wavelength in the HF band. Similarly, the vertical spacing 415 (also referred to as the height $h_2$) has a value from about $0.02\lambda_{LF,ref}$ to about $0.1\lambda_{LF,ref}$, where $\lambda_{LF,ref}$ is a reference operational wavelength in the LF band.

Refer to FIG. 4B. The LF radiating gap 454 is formed between the outer periphery 406O of the LF radiator 406 and the underlying ground plane 404. The HF radiating gap 452 is formed between the inner periphery 4081 of the HF radiator 408 and the outer surface 4020 of the cylindrical tube 402. Note that the LF radiating gap 454 is vertical (aligned parallel to the longitudinal axis); whereas, the HF radiating gap 452 is horizontal (aligned orthogonal to the longitudinal axis). The inner diameter of the HF radiating gap 452 is denoted $D_{HF}$; as is evident from FIG. 4B, $D_{HF}$ is equal to the outer diameter 403 of the cylindrical tube 402. In an embodiment, $D_{HF}$ is about $0.26\lambda_{HF,ref}$. This value expands the antenna pattern, improves the down/up ratio, and decreases the mutual interaction (unwanted coupling) between the LF radiator and the HF radiator. In other embodiments, $D_{HF}$ has a value from about $0.15\lambda_{HF,ref}$ to about $0.4\lambda_{HF,ref}$.

The set of HF capacitive elements 460 is azimuthally spaced about the longitudinal axis and is bounded on the outer periphery by the reference circle 460O (with a diameter 461). In the embodiment shown in FIG. 4A, the set of HF capacitive elements 460 has 8 HF capacitive elements, referenced as HF capacitive element 460-1 through HF capacitive element 460-8 (to simplify the drawing, only the representative reference numbers 420-1 and 420-8 are shown). The number of HF capacitive elements is selected to yield the desired azimuthal symmetry in the antenna pattern. For example, eight HF capacitive elements are acceptable for some designs. The maximum number of HF capacitive elements is arbitrary (as long as a gap is maintained between adjacent HF capacitive elements). In the embodiment shown, each HF capacitive element has an approximately rectangular shape with a length 467 along a radial axis and a width 465 orthogonal to a radial axis.

In FIG. 4B, the HF capacitive element 460-1 and the HF capacitive element 460-5 are shown. Each HF capacitive element is aligned orthogonal to the longitudinal axis 207. Each HF capacitive element is electrically connected, for example by a solder joint, to the outer surface 402O of the cylindrical tube 402. Refer to the representative HF capacitive element 460-5. It has a thickness 465, measured between the bottom surface 460B-5 and the top surface 460T-5. The vertical spacing between the top surface 408T of the HF radiator 408 and the bottom surface 460B-5 of the HF capacitive element 460-5 is the vertical spacing 463. The set of HF capacitive elements 460 can overhang the HF radiator 408 (that is, the diameter 461 can be greater than the diameter 405). Capacitive coupling between the set of HF capacitive elements 460 and the HF radiator 408 is used to tune the operational parameters of the HF radiator 408.

The set of parasitic elements 420 is azimuthally spaced about the longitudinal axis and is bounded by the reference circle 410I (with a diameter 409) and the reference circle 410O (with a diameter 411). In the embodiment shown in FIG. 4A, the set of parasitic elements 420 has 12 parasitic elements, referenced as parasitic element 420-1 through parasitic element 420-12 (to simplify the drawing, only the representative reference numbers 420-1, 420-2, 420-7, and 420-12 are shown). The number of parasitic elements is selected to yield the desired azimuthal symmetry in the antenna pattern. For example, eight parasitic elements are acceptable for some designs. The maximum number of parasitic elements is arbitrary (as long as a gap is maintained between adjacent parasitic elements).

In the embodiment shown, each parasitic element includes a vertical segment and a horizontal segment. In other embodiments, each parasitic element has a vertical segment only (no horizontal segment). To representative parasitic elements are shown in FIG. 4B: the parasitic element 420-1 includes the vertical segment 414-1 and the horizontal segment 416-1; and the parasitic element 420-7 includes the vertical segment 414-7 and the horizontal segment 416-7.

The cross-sectional geometry of a vertical segment is arbitrary. In one example, the vertical segment 414-7 is a cylindrical post with a diameter 443. The bottom end face of vertical segment 414-7 is electrically connected to the top surface 404T of the ground plane 404, and the top end face of the vertical segment 414-7 is electrically connected to the bottom surface 416B-7 of the horizontal segment 416-7. The vertical spacing between the top surface 404T of the ground plane 404 and the top surface 4161-7 of the horizontal segment 416-7 is the vertical spacing 421. In the embodiment shown, the vertical spacing 421 is equal to the vertical spacing 423 between the top surface 404T of the ground plane 404 and the top surface 408T of the HF radiator 408. In other embodiments, the vertical spacing 421 is not equal to the vertical spacing 423. The horizontal segment 416-7 has a thickness 435 (measured between the bottom surface 416B-7 and the top surface 416T-7)

Refer to FIG. 4A. The parasitic element 420-2 is shown with a reference radial axis 453-2 and a reference azimuthal angle 451-2. In the embodiment shown, the horizontal segment element 416-2 has an approximately rectangular shape with a length 447 along the reference radial axis 453-2 and a width 445 orthogonal to the reference radial axis 453-2. In FIG. 4B, the capacitive element 410-1 and the capacitive element 410-7 are shown.

Figure 6:
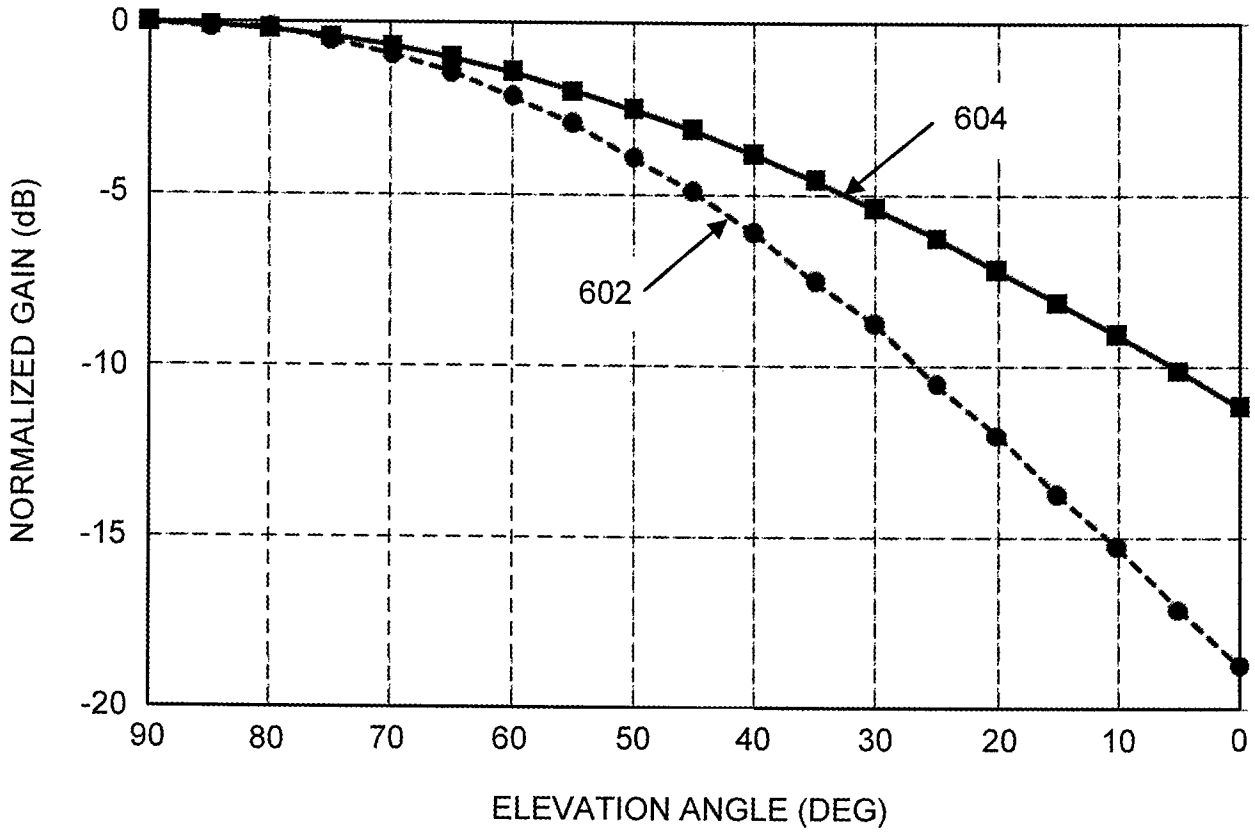
FIG. 6 shows plots of normalized gain as a function of elevation angle.

The set of parasitic elements 420 improves the antenna performance. FIG. 6 shows plots of the normalized gain (dB) as a function of elevation angle (deg). Plot 602 shows the results for an antenna without a set of parasitic elements. Plot 604 shows the results for an antenna with a set of parasitic elements. With a set of parasitic elements, there is greater than a 5 dB improvement in gain for elevation angles of 20 deg or less.

Figure 7:
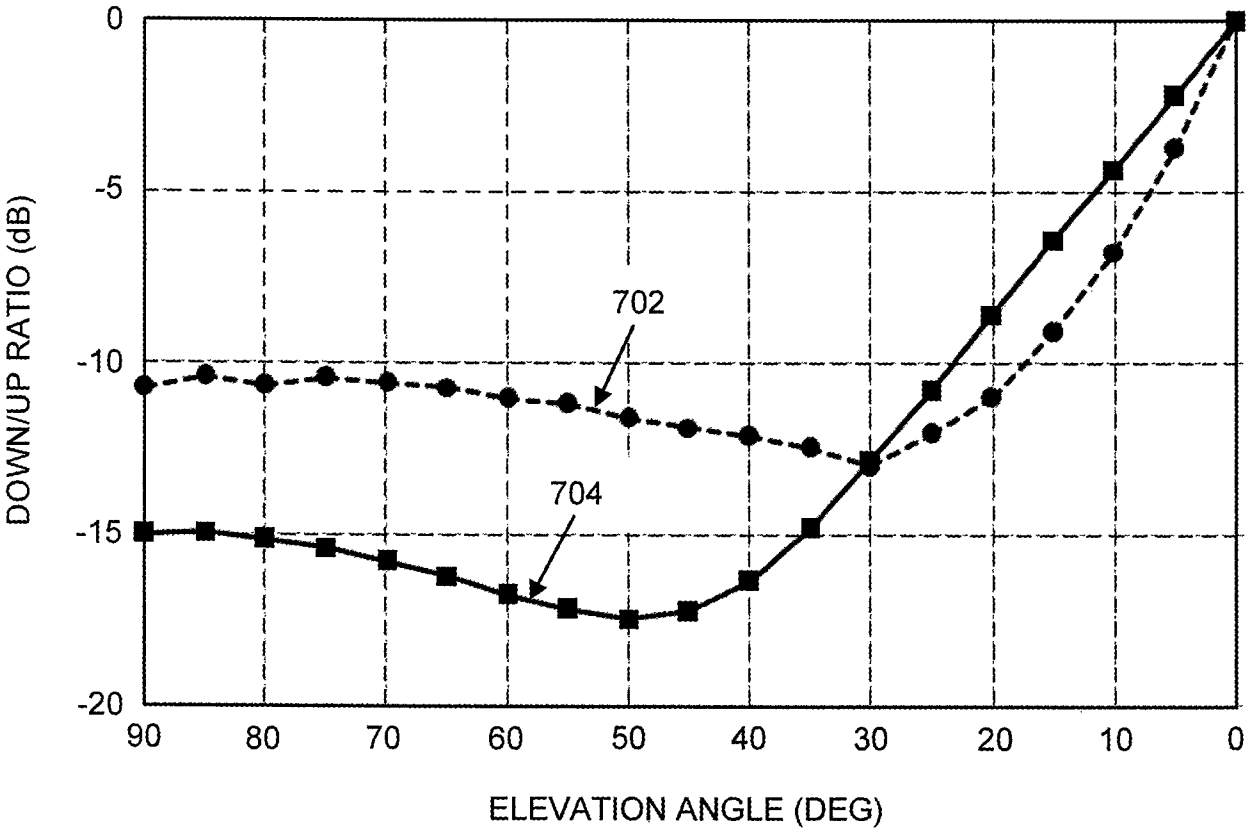
FIG. 7 shows plots of down/up ratio as a function of elevation angle.

FIG. 7 shows plots of down/up ratio (dB) as a function of elevation angle (deg). Plot 702 shows the results for an antenna without a set of parasitic elements. Plot 704 shows the results for an antenna with a set of parasitic elements. Between 40 deg and 90 deg there is a 5 dB or better improvement with the set of parasitic elements. Between 30 deg and 0 deg there is a slight degradation with the set of parasitic elements.

Figure 5A:
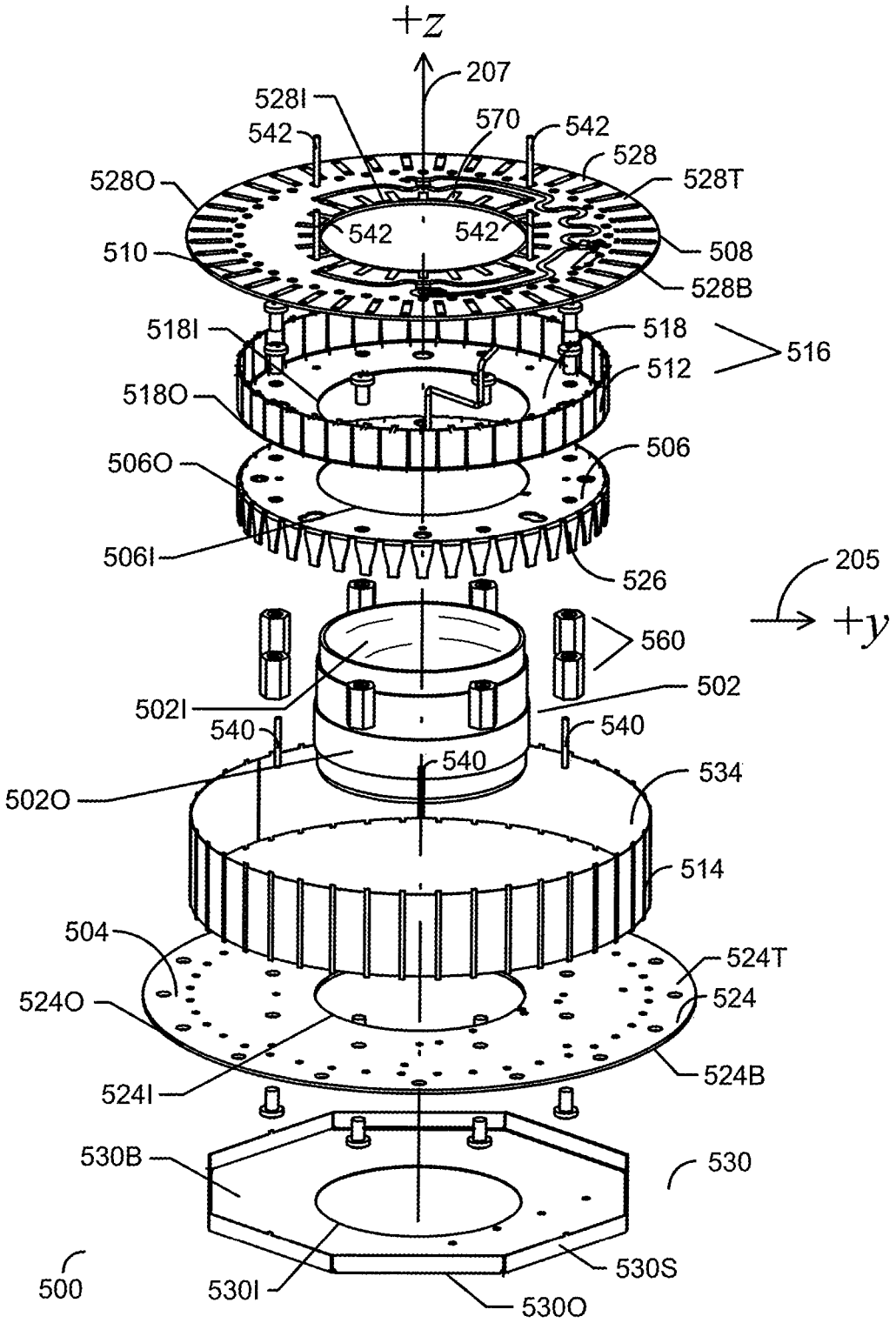
FIG. 5A-FIG. 5V show schematics of an antenna system, according to an embodiment of the invention.
Figure 5B:
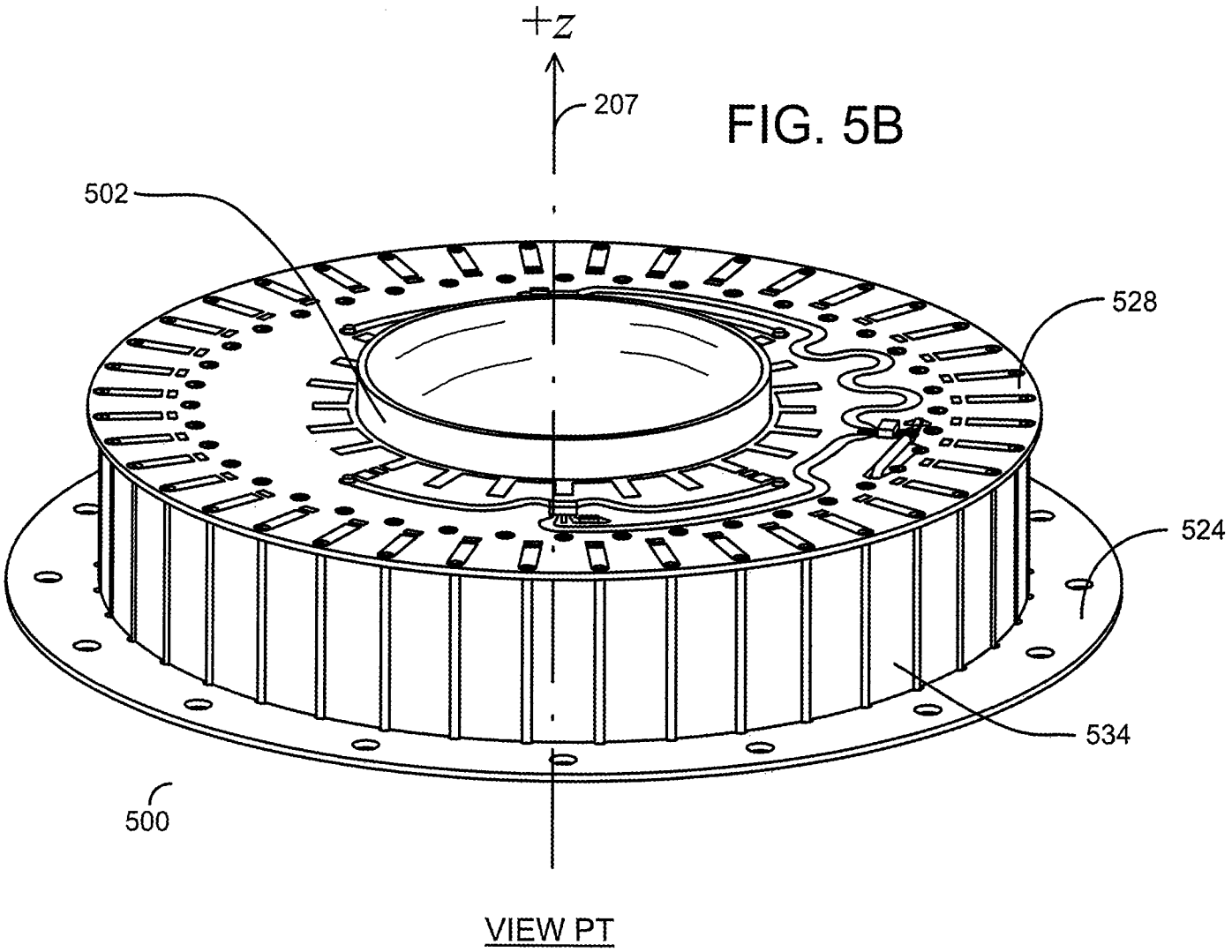
Figure 5C:
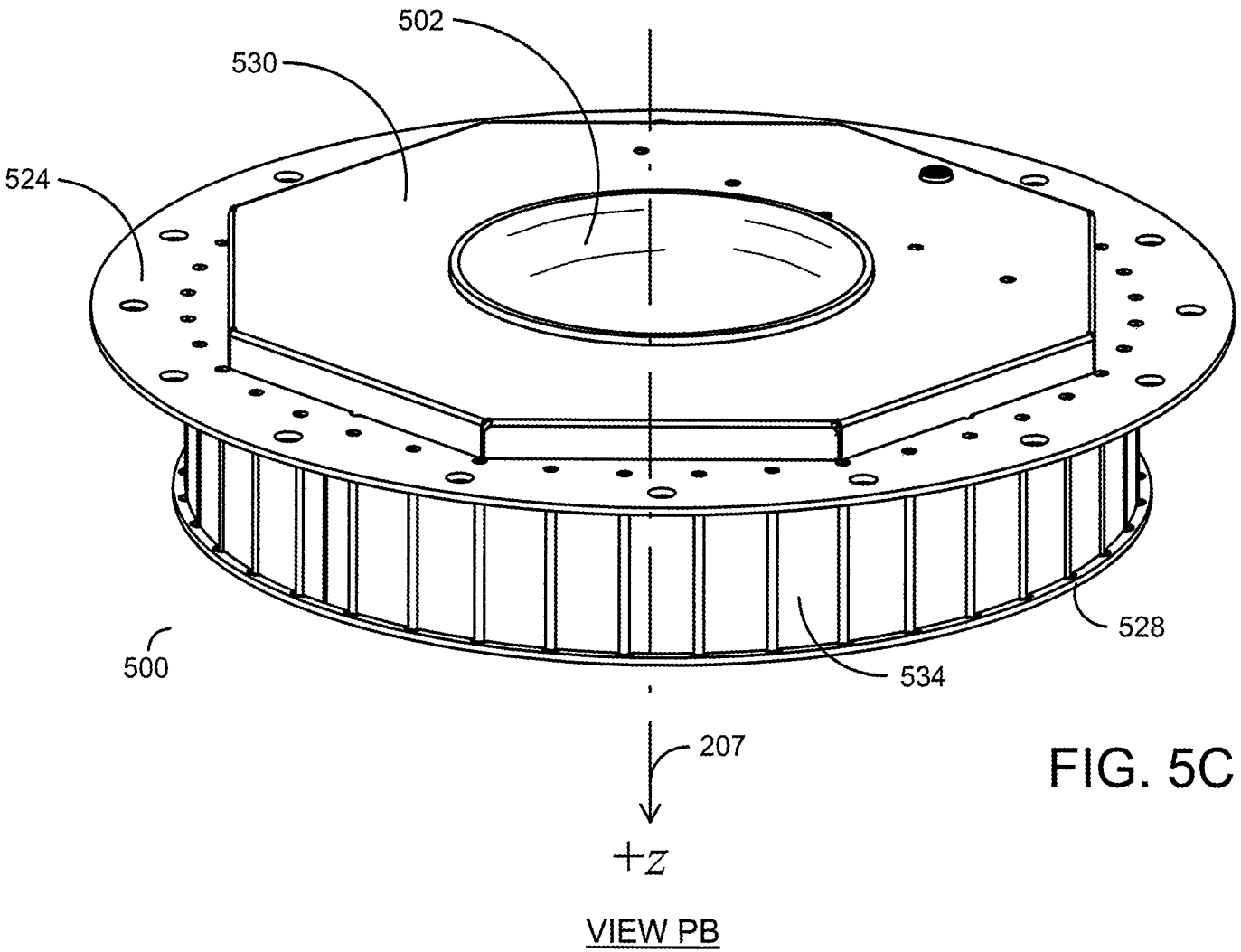
Figures 5D, 5E:
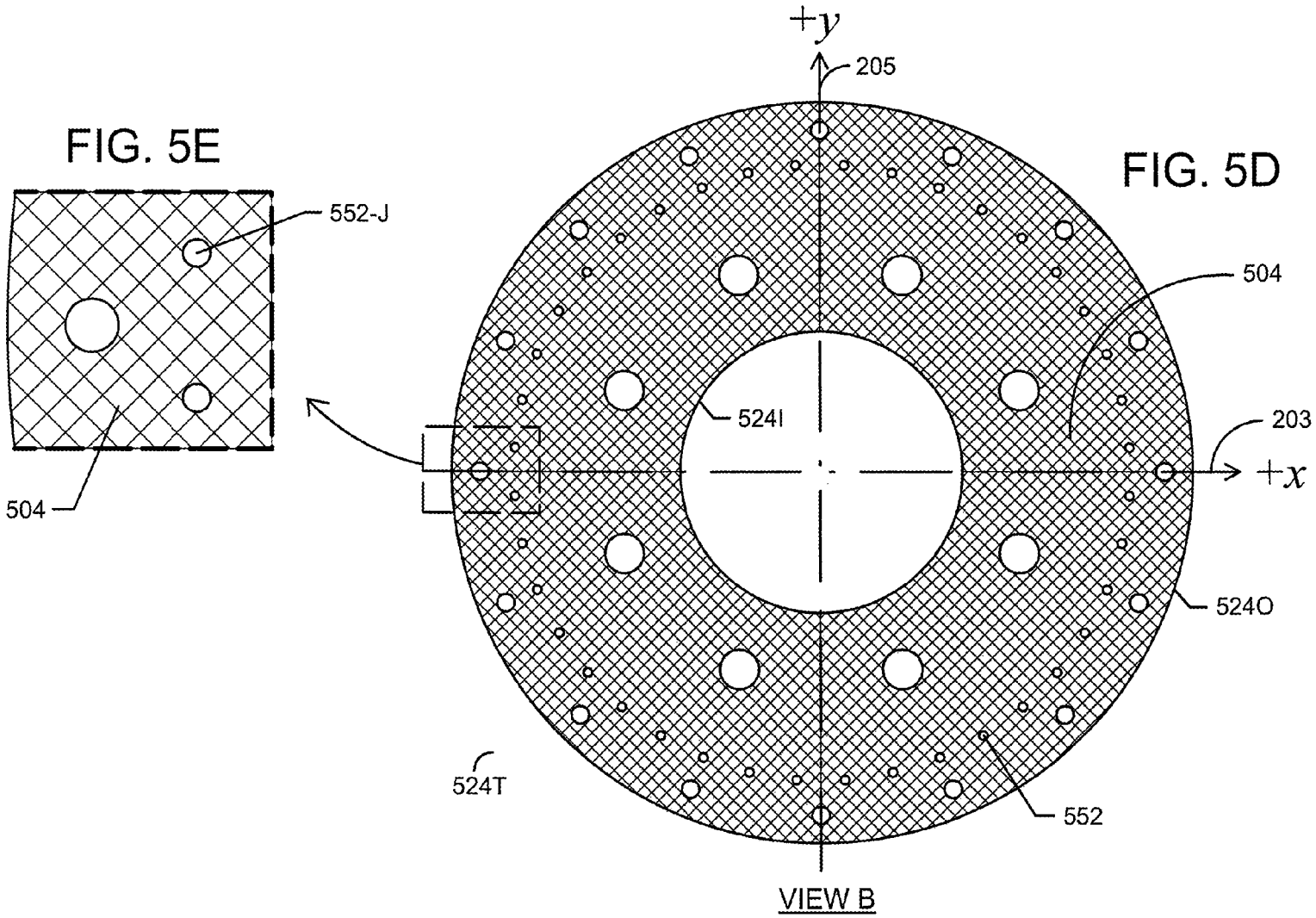
Figure 5F:
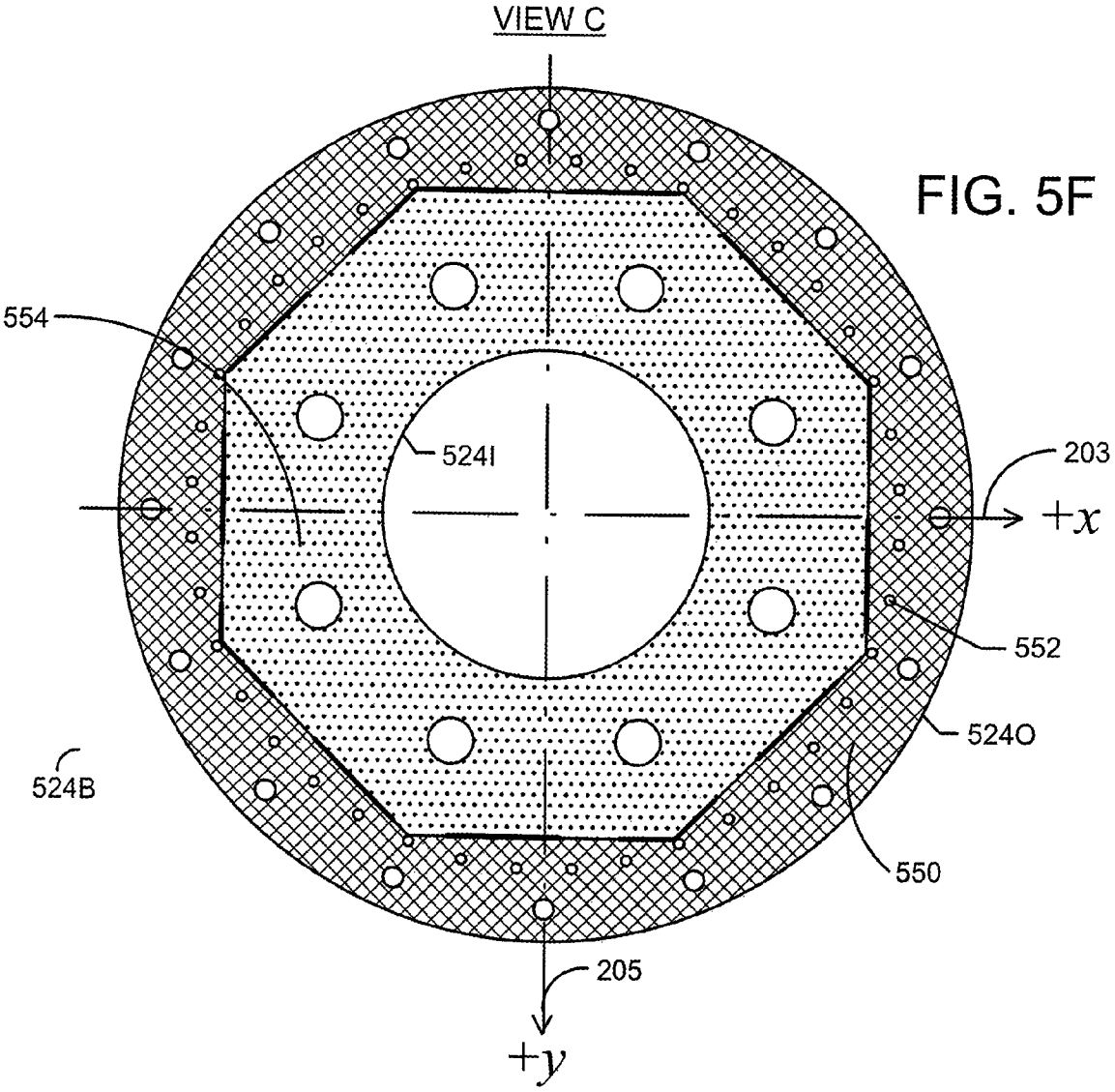
Figure 5G:
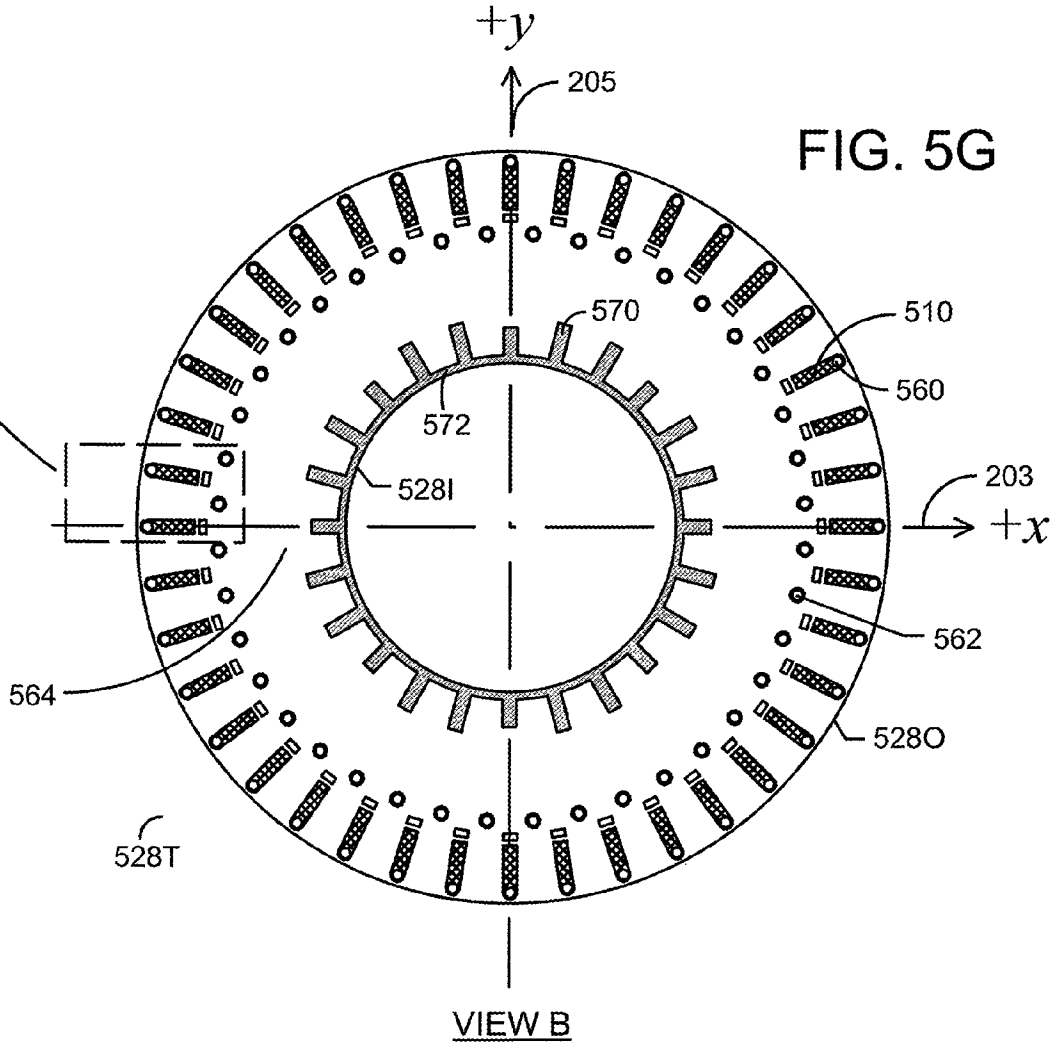
Figure 5H:
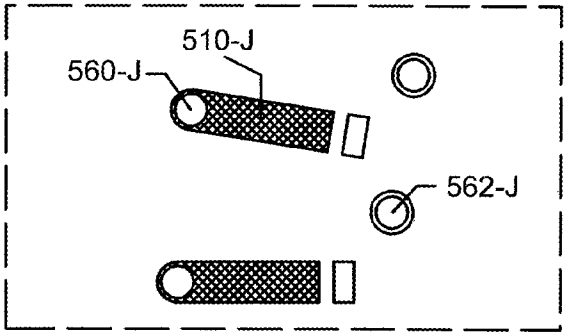
Figures 5I, 5J:
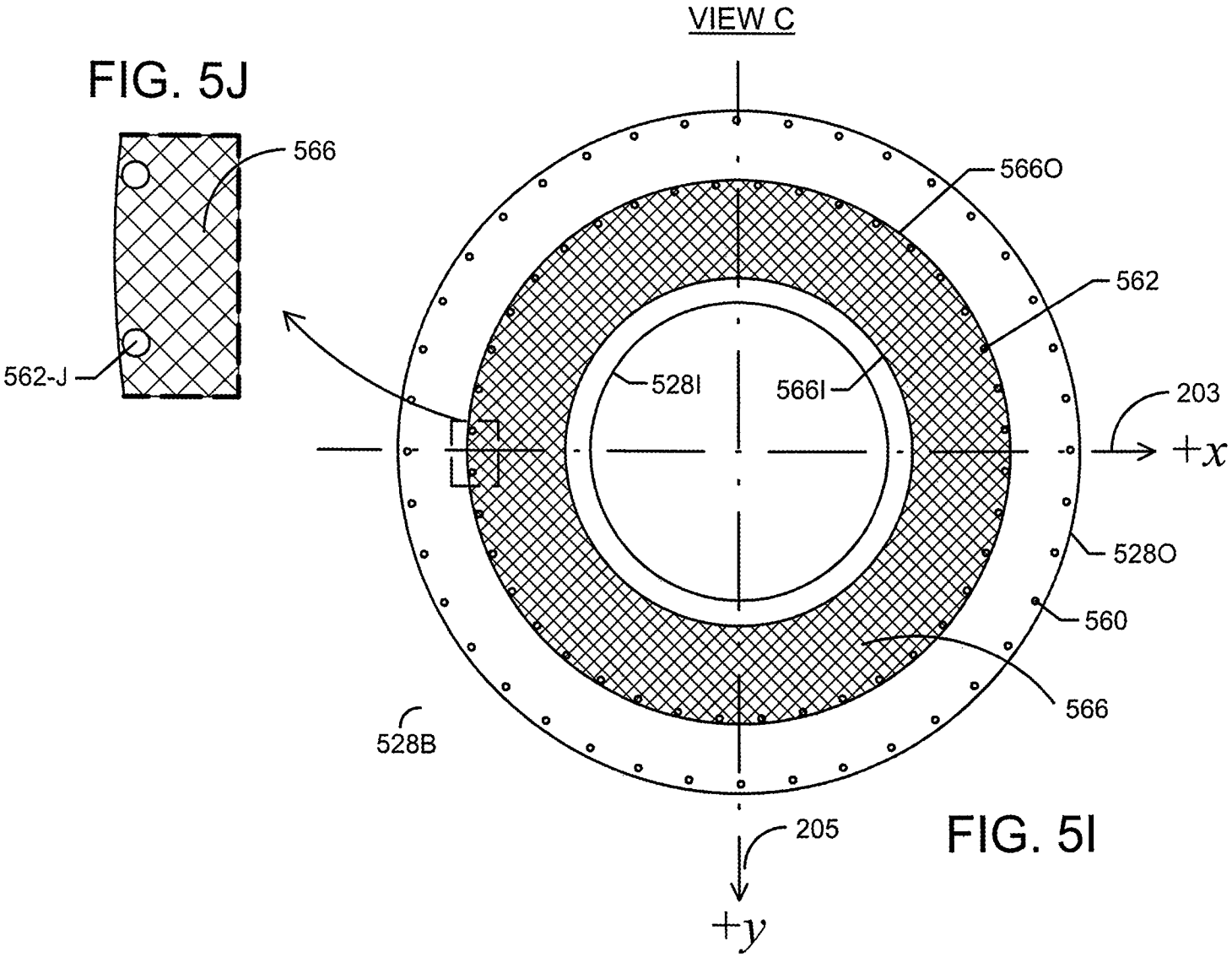
Figure 5O:
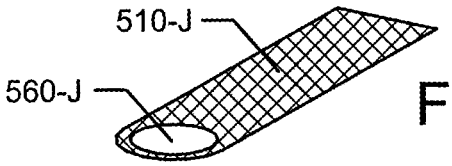
Figure 5P:
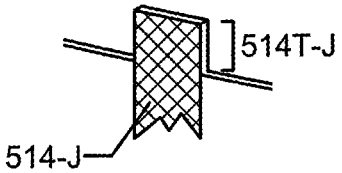
Figure 5N:
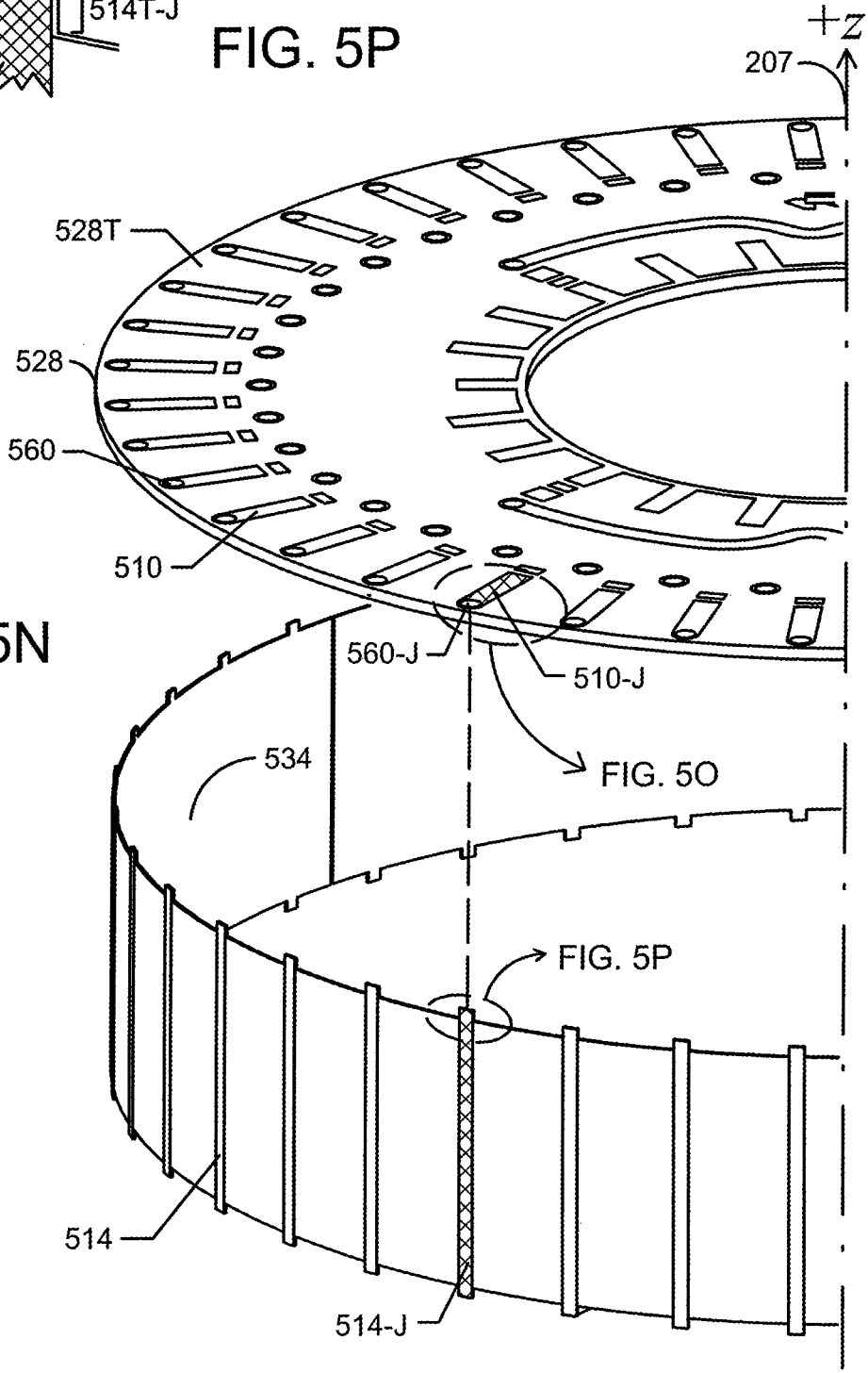
Figure 5R:
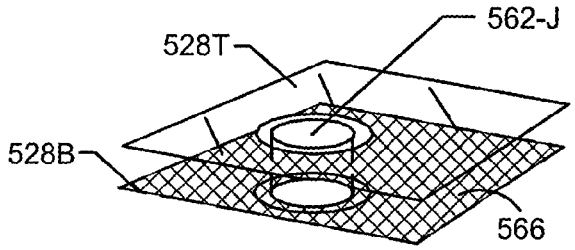
Figure 5S:
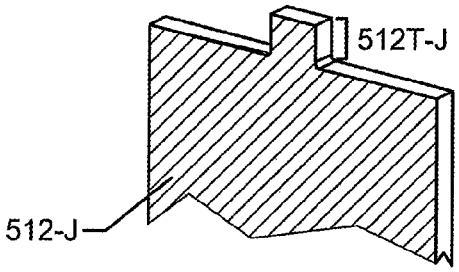
Figure 5Q:
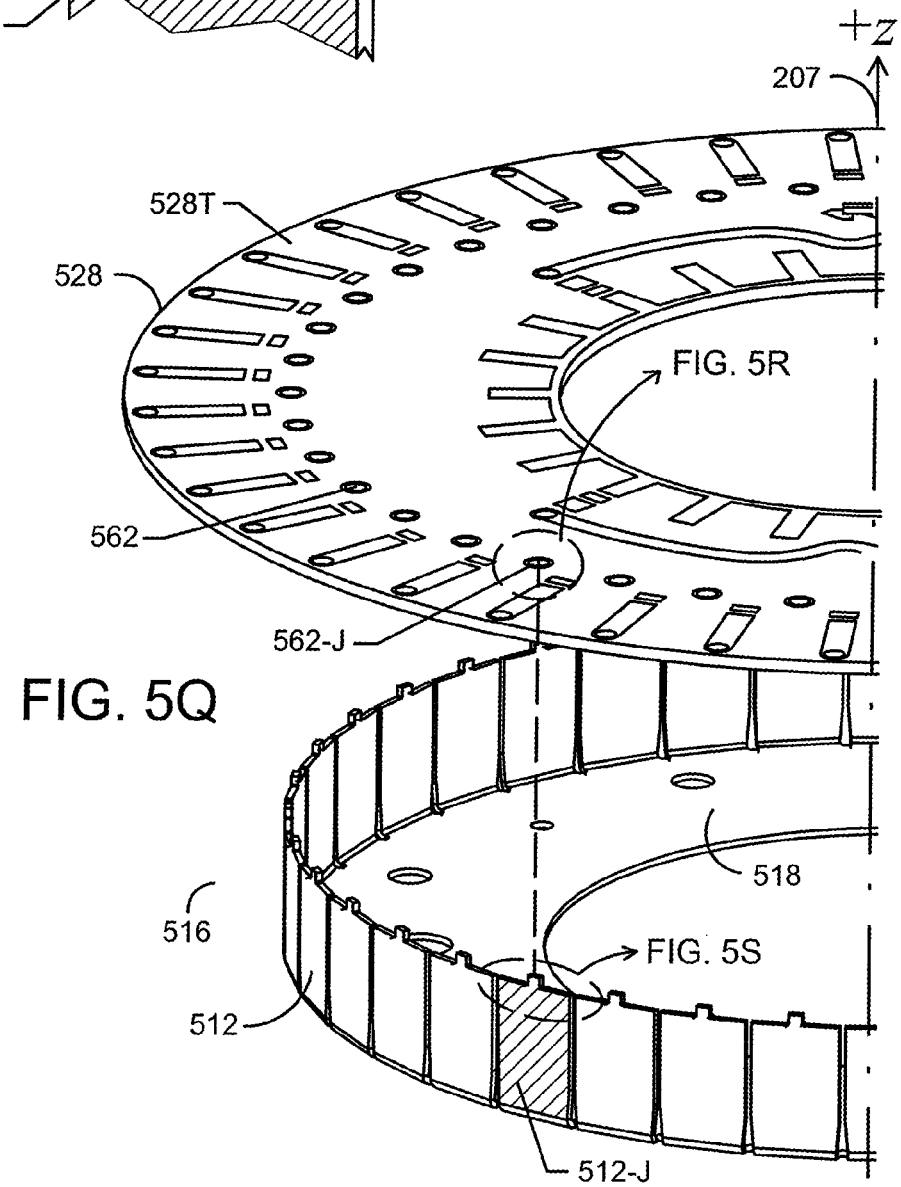
Figure 5T:
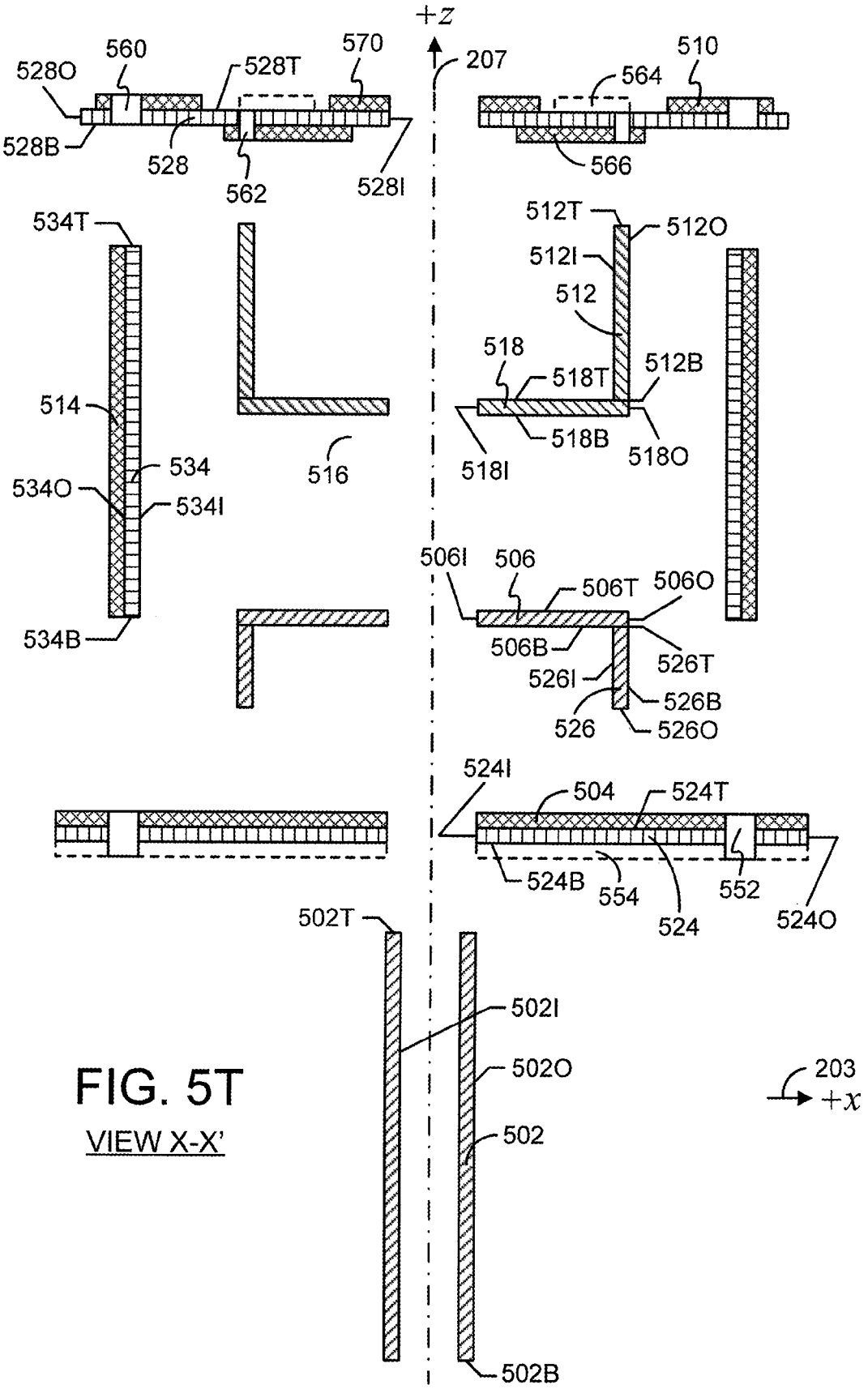
Figure 5U:
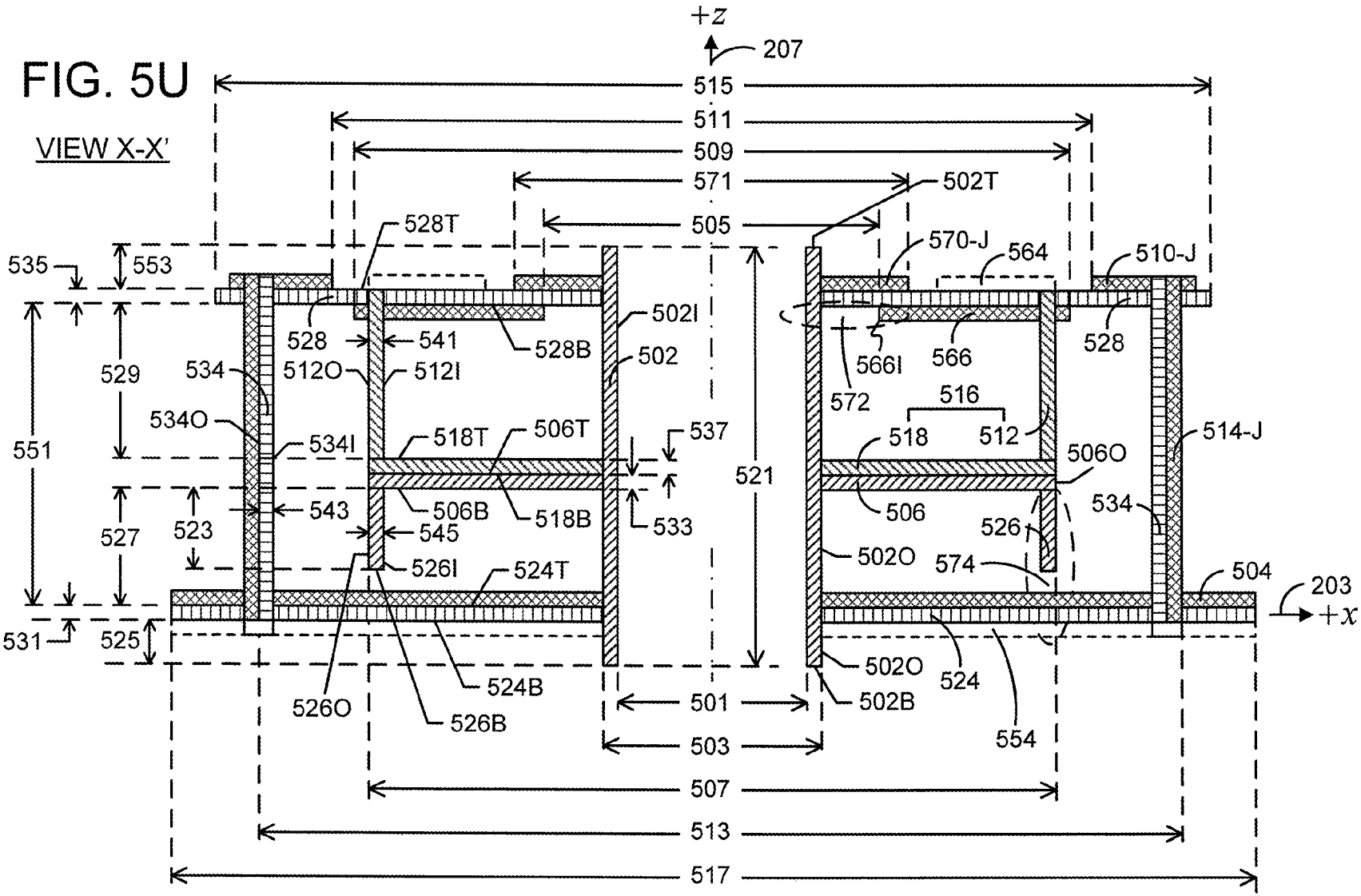
Figure 5V:
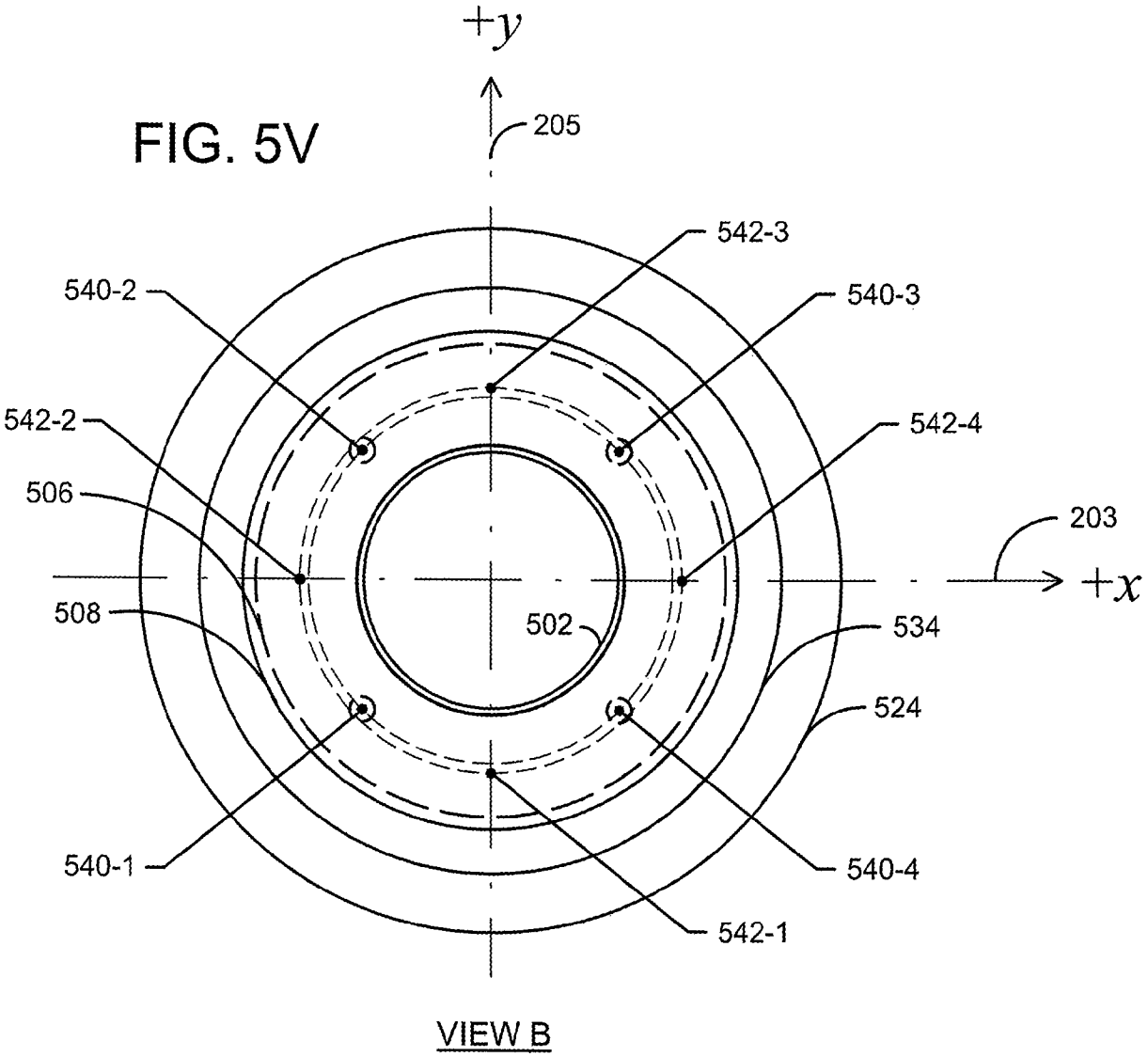

FIG. 5A-FIG. 5V show an antenna system, according to an embodiment of the invention. The antenna system includes an antenna, an excitation system, and a low-noise amplifier (LNA).

FIG. 5A shows a perspective exploded view (View PX). The antenna system 500 includes the cylindrical tube 502, which has the outer surface 502O and the inner surface 502I. In this example, the outer surface 502O has several steps of different diameters to facilitate mechanical assembly. To simplify the description, these minor variations in the outer surface are ignored. The printed circuit board (PCB) 524 has the geometry of an annulus with a circular outer periphery 524O and a circular inner periphery 524I. The PCB 524 has a top side 524T and a bottom side 524B. Refer to FIG. 5D. The top side 524T is metallized (represented by the cross-hatching) to form the ground plane 504. The circular inner periphery 524I of the PCB 524 is soldered to the outer surface 502O of the cylindrical tube 502. Refer to FIG. 5F. On the bottom side 524B, the region 550 near the outer periphery is metallized (represented by the cross-hatching). A low-noise amplifier (LNA) and a portion of an excitation system are fabricated within the octagonal region 554 (represented by dots). Details of the LNA and the excitation system are described and illustrated below.

Return to FIG. 5A. The LNA and a portion of the excitation system are covered by the conductive shield 530, which includes a base plate 530B and a sidewall 530S. The base plate 530B has a circular inner periphery 530I and an outer periphery 530O. The geometry of the outer periphery 530O is arbitrary; in this example, it is octagonal. The circular inner periphery 530I of the base plate 530B is soldered to the outer surface 502O of the cylindrical tube 502.

The LF radiator 506 is fabricated as a conductive annulus with a circular outer periphery 506O and a circular inner periphery 502I. In the embodiment shown, around the circular outer periphery 506O is a set of LF capacitive elements 526 aligned orthogonal to the plane of the LF radiator 506. In this example, the LF radiator 506 and the set of LF capacitive elements 526 are fabricated from a single piece of sheet metal. Notches are cut out from the outer periphery of the sheet, and the resulting tabs are bent 90 deg to form the set of LF capacitive elements 526. Other manufacturing techniques can be used; for example, the set of LF capacitive elements can be soldered or mechanically fastened to the LF radiator. The LF radiator 506 is supported above the PCB 524 by the set of dielectric standoffs 560. The set of LF capacitive elements 526, which provides capacitive coupling between the outer periphery 506O of the LF radiator 506 and the ground plane 504, serves as wave-slowing structures and permits the outer diameter of the LF radiator 506 to be reduced.

The printed circuit board (PCB) 528 has the geometry of an annulus with a circular outer periphery 528O and a circular inner periphery 528I. The PCB 528 has a top side 528T and a bottom side 528B. Refer to FIG. 5I. A portion of the bottom side 528B is metallized (represented by the cross-hatching) to form the HF radiator 566, which has the geometry of an annulus, with a outer circular periphery 566O and an inner circular periphery 566I.

Return to FIG. 5A. The HF radiator 566 is electrically connected to the LF radiator 506 by the conductive support ring 516. The support ring 516 includes the base plate 518 and the set of sidewall segments 512 aligned orthogonal to the plane of the base plate 518. The base plate 518 is fabricated as an annulus with a circular outer periphery 518O and a circular inner periphery 518I. The base plate 518 is mechanically fastened to the LF radiator 506. The circular inner periphery 518I is soldered to the outer surface 502O of the cylindrical tube 502.

Refer to FIG. 5Q, which shows a close-up view of a portion of the support ring 516 and a portion of the PCB 528. In this example, the base plate 518 and the set of sidewall segments 512 are fabricated from a single piece of sheet metal. Notches are cut out from the outer periphery of the sheet, and the resulting tabs are bent 90 deg to form the set of sidewall segments 512. Other manufacturing techniques can be used. For example, instead of a set of sidewall segments, a continuous sidewall can be fabricated from a cylindrical tube and attached to the base plate 518 with solder or mechanical fasteners. In another example, the base plate 518 can be eliminated, and a continuous sidewall can be attached directly to the LF radiator 506.

The set sidewall segments 512 are electrically connected to the HF radiator 566 fabricated on the bottom side 528B of the PCB 528. Refer to FIG. 5I. A circular set of vias 562 is configured about the outer periphery 566O of the HF radiator 566. A representative via 562-J is shown in the close-up view of FIG. 5J. Return to FIG. 5Q. A representative sidewall segment 512-J and a corresponding representative via 562-J are shown. FIG. 5S shows a close-up view of the top portion of the sidewall segment 512-J. The top portion has a tab (protrusion) 512T-J. FIG. 5R shows a close-up view of a portion of the PCB 528. The HF radiator 566 is fabricated on the bottom side 528B. The via 562-J passes through the top side 528T and the bottom side 528B. The tab 512T-J of the sidewall segment 512-J is inserted into the via 562-J. The tabs of the other sidewall segments are similarly inserted into corresponding vias in the PCB 528. The sidewall segments are soldered to the HF radiator 566.

Return to FIG. 5A. The printed circuit board (PCB) 534 is a flexible PCB wrapped into a cylindrical tube. A circular set of conductive strips 514 is fabricated on the outer surface of the PCB 534. The bottom ends of the conductive strips are electrically connected to the ground plane 504; the top ends of the conductive strips are electrically connected to horizontal segments on the PCB 528. The set of conductive strips 514 serve as a set of vertical segments for a set of parasitic elements. Further details are described below.

Refer to FIG. 5D. Passing through the PCB 524 is a circular set of vias 552. FIG. 5E shows a close-up view of a representative via 552-J. Refer to FIG. 5K, which shows a close-up view of a portion of the PCB 534 and a portion of the PCB 504. A representative conductive strip 514-J and a representative via 552-J are shown. The PCB 534 is fabricated with a first (top) circular set of tabs (protrusions) along the top edge of the PCB 534 and a second (bottom) circular set of tabs (protrusions) along the bottom edge of the PCB 534. The top circular set of tabs is vertically aligned with the bottom circular set of tabs. The set of conductive strips is fabricated as a set of metallized strips extending from the top circular set of tabs to the bottom circular set of tabs.

FIG. 5L shows a close-up view of a portion of the conductive strip 514-J terminating in the bottom tab 514B-J. FIG. 5M shows a close-up view of the corresponding via 552-J and a surrounding portion of the ground plane 504. The tab 514B-J is inserted into the via 552-J, and the conductive strip 514-J is soldered to the ground plane 504. Similarly, the bottom tabs of the other conductive strips are inserted into corresponding vias, and the conductive strips are soldered to the ground plane.

Refer to FIG. 5G. A circular set of conductive horizontal segments 510 is fabricated on the top side 528T of the PCB 528. The set of horizontal segments 510 serve as a set of horizontal segments for a set of parasitic elements. There is a circular set of vias 560 passing through the PCB 528. The circular set of vias 560 is aligned with the circular set of horizontal segments 510 such that a via passes through each horizontal segment near the outer periphery of the horizontal segment. FIG. 5H shows a close-up view of a representative horizontal segment 510-J and a corresponding via 560-J.

Refer to FIG. 5N, which shows a close-up view of a portion of the PCB 528 and a portion of the PCB 534. A representative conductive strip 514-J, a representative horizontal segment 510-J, and a representative via 560-J are shown. FIG. 5O shows a close-up view of the horizontal segment 510-J and the via 560-J. FIG. 5P shows a close-up view of a portion of the conductive strip 514-J terminating in the top tab 514T-J. The top tab 514T-J is inserted into the via 560-J, and the conductive strip 514-J is soldered to the horizontal segment 510-J. Similarly, the top tabs of the other conductive strips are inserted into corresponding vias, and the conductive strips are soldered to the corresponding horizontal segments. Thus a set of parasitic elements are formed from the set of vertical segments (the set of conductive strips 514) and the set of horizontal segments 510.

Return to FIG. 5G. A circular set of HF capacitive elements 570 is fabricated on the top side 528T of the PCB 528. In this example, the lengths of the HF capacitive elements (measured along a radial direction) can vary. The inner ends of the HF capacitive elements terminate in a metallized ring 572 around the inner periphery 528I. The metallized ring 572 is electrically connected (for example, by a solder joint) to the outer surface 502O of the cylindrical tube 502. The circular set of HF capacitive elements 570 capacitively couple to the HF radiator 566 on the bottom side 528B of the PCB 528 (FIG. 5I).

FIG. 5B shows a top perspective view (View PT) of the assembled antenna system 500. FIG. 5C shows a bottom perspective view (View PB) of the assembled antenna system 500.

Principal features of the antenna system 500 are summarized in FIG. 5T and FIG. 5U, which show schematics in a cross-sectional view (View X-X' taken in the x-z plane). The shield 530 is not shown. FIG. 5T shows an exploded view; FIG. 5U shows an assembled view. To highlight particular details, the drawings are not to scale. In particular, metallization on a PCB is shown as having an appreciable thickness relative to the thickness of the PCB; in practice, the thickness of the metallization is negligible.

FIG. 5T shows the individual components. The cylindrical tube 502 has an inner surface 502I, an outer surface 502O, a bottom end face 502B, and a top end face 502T. The PCB 524 has a circular outer periphery 524O, a circular inner periphery 524I, a top side 524T, and a bottom side 524B. A circular set of vias 552 passes through the PCB 524 from the top side 524T to the bottom side 524B. The ground plane 504 is fabricated from metallization on the top side 524T. A low-noise amplifier (LNA) and a portion of an excitation system are fabricated in the region 554 on the bottom side 524B.

The LF radiator 506 has a circular inner periphery 506I, a circular outer periphery 506O, a top surface 506T, and a bottom surface 506B. A circular set of LF capacitive elements 526 is configured around the circular outer periphery 506O. The circular set of LF capacitive elements 526 has an inner periphery 526I, an outer periphery 526O, a top end face 526T, and a bottom end face 526B. The circular set of LF capacitive elements 526 is aligned orthogonal to the plane of the LF radiator 506.

The support ring 516 includes the base plate 518 and the sidewall 512. The base plate 518 has a circular inner periphery 518I, a circular outer periphery 518O, a top surface 518T, and a bottom surface 518B. The sidewall 512 has an inner surface 512I, an outer surface 512O, a top end face 512T, and a bottom end face 512B (to simplify the drawing, details of the tabs are not shown).

The PCB 534 has an inner surface 534I, an outer surface 534O, a top end face 534T, and a bottom end face 534B. There is a circular set of conductive strips 514 fabricated on the outer surface 534O. Each conductive strip is aligned along the longitudinal axis.

The PCB 528 has a circular inner periphery 528I, a circular outer periphery 528O, a top side 528T, and a bottom side 528B. A first circular set of vias 560 passes through the PCB 528 from the top side 528T to the bottom side 528B. A second circular set of vias 562 passes through the PCB 528 from the top side 528T to the bottom side 528B. The HF radiator 566 is fabricated on the bottom side 528B. A set of HF capacitive elements 570 and a set of horizontal segments 510 is fabricated on the top side 528T. A portion of an excitation system is fabricated in the region 564 on the top side 528T.

FIG. 5U shows the assembled antenna system. The cylindrical tube 502 has an inner diameter 501, an outer diameter 503, and a height 521 (measured between the bottom end face 502B and the top end face 502T). The PCB 524 has an outer diameter 517, an inner diameter 503, and a thickness 531 (measured between the bottom surface 524B and the top surface 524T). The ground plane 504 is fabricated on the top side 524T. The LNA and a portion of the excitation system are fabricated in the region 554 on the bottom side 524B.

The LF radiator 506 has an outer diameter 507, an inner diameter 503, and a thickness 533 (measured between the bottom surface 506B and the top surface 506T). The circular set of LF capacitive elements 526 has an outer diameter 507, a wall thickness 545 (measured between the inner surface 526I and the outer surface 526O), and a height 523 (measured between the bottom surface 506B of the LF radiator 506 and the bottom end face 526B of the circular set of LF capacitive elements 526).

The PCB 528 has an outer diameter 515, an inner diameter 503, and a thickness 535 (measured between the top side 528T and the bottom side 528B). The circular set of HF capacitive elements 570 is fabricated on the top side 528T (a representative HF capacitive element 570-J is labelled); the circular set of HF capacitive elements 570 has an outer diameter 571. The circular set of horizontal segments 510 is fabricated on the top side 528T (a representative horizontal segment 510-J is labelled); the circular set of horizontal segments 510 has an inner diameter 511. A portion of the excitation system is fabricated in the region 564 of the top side 528T.

The HF radiator 566 is fabricated on the bottom side 528B. The HF radiator 566 has an outer diameter 509 and an inner diameter 505. The support ring 516 includes the base plate 518 and the circular set of sidewall segments 512. The base plate 518 has an outer diameter 507, an inner diameter 503, and a thickness 537 (measured between the top surface 518T and the bottom surface 518B). The circular set of sidewall segments 512 has an outer diameter 507 and a wall thickness 541 (measured between the inner surface 512I and the outer surface 512O). The base plate 518 is electrically connected to the LF radiator 506, and the circular set of sidewall segments 512 is electrically connected to the HF radiator 566.

The PCB 534 has an outer diameter 513 and a wall thickness 543 (measured between the outer surface 534O and the inner surface 534I. A circular set of conductive strips 514 is fabricated on the outer surface 534O (a representative conductive strip 514-J is labelled). The circular set of conductive strips 514 electrically connects the circular set of horizontal segments 510 to the ground plane 504.

The vertical spacing between the bottom end face 502B of the cylindrical tube 502 and the bottom surface 524B of the PCB 524 is the vertical spacing 525. The vertical spacing between the top surface 524T of the PCB 524 and the bottom surface 506B of the LF radiator 506 is the vertical spacing 527. The vertical spacing between the top surface 518T of the base plate 518 and the bottom surface 528B of the PCB 528 is the vertical spacing 529. The vertical spacing between the top surface 524T of the PCB 524 and the bottom surface 528B of the PCB 528 is the vertical spacing 551. The vertical spacing between the top surface 528T of the PCB 528 and the top end face 502T of the cylindrical tube 502 is the vertical spacing 553.

The antenna system 500 is excited by a dual-band pin excitation system. Refer to FIG. 5A and FIG. 5V. The LF radiator 506 is excited by a set of four LF exciter pins 540 (referenced individually as LF exciter pin 540-1, LF exciter pin 540-2, LF exciter pin 540-3, and LF exciter pin 540-4); and the HF radiator 566 (FIG. 5I) is excited by a set of four HF exciter pins (referenced individually as HF exciter pin 542-1, HF exciter pin 542-2, HF exciter pin 542-3, and HF exciter pin 540-4). Each LF exciter pin 540 is electrically connected at one end to the LF radiator 506 and is electrically connected at the other end to the bottom side 524B of the PCB 524. Each HF exciter pin 542 is electrically connected at one end to the HF radiator 566 and is electrically connected at the other end to the top side 528T of the PCB 528. Refer to FIG. 5V, the LF exciter pins 540 are azimuthally spaced apart at 90 deg intervals; and the HF exciter pins are azimuthally spaced apart at 90 deg intervals.

Figure 9A:
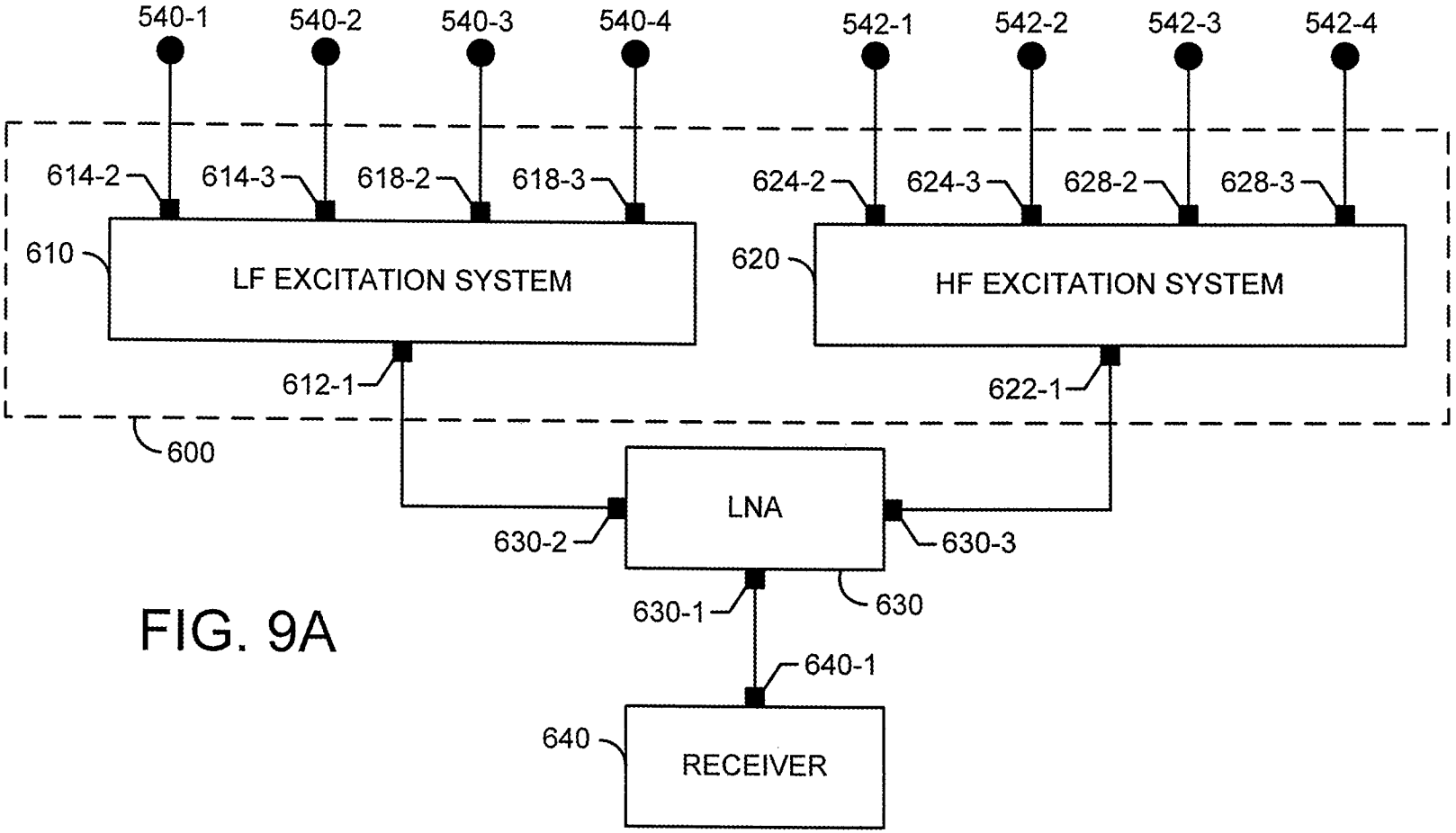
FIG. 9A-FIG. 9C show schematics of an embodiment of an excitation system.

FIG. 9A shows a schematic of a dual-band excitation system 600, which includes a LF excitation system 610 and a HF excitation system 620. Details of the LF excitation system 610 and the HF excitation system 620 are described below, with reference to FIG. 9B and FIG. 9C, respectively. Described in the receive mode, the output port 612-1 of the LF excitation system 610 is electrically connected to the LF input port 630-2 of the dual-channel low-noise amplifier (LNA) 630; similarly, the output port 622-1 of the HF excitation system 620 is electrically connected to the HF input port 630-3 of the LNA 630. The output port 630-1 of the LNA 630 is electrically connected to the input port 640-1 of the receiver 640.

Figure 9B:
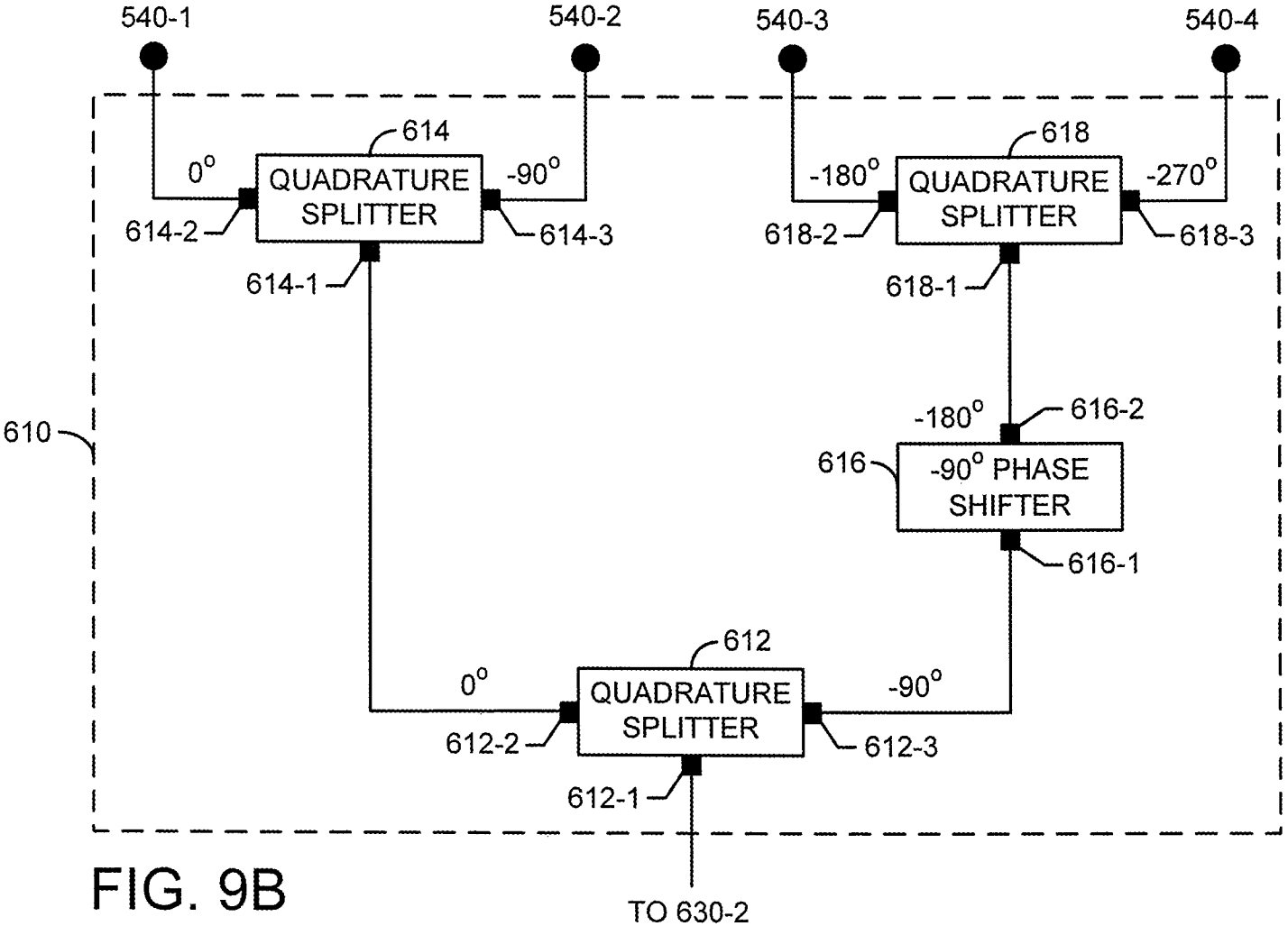

The LF excitation system 610 is shown schematically in FIG. 9B and described in the transmit mode. Refer to the quadrature splitter 612. The input port 612-1 is electrically connected to the port 630-2 of the LNA 630. With respect to the signal at the input port 612-1, the signal at the output port 612-2 is in-phase (0 deg phase shift), and the signal at the output port 612-3 is phase shifted by −90 deg. The output port 612-2 is electrically connected to the input port 614-1 of the quadrature splitter 614. With respect to the signal at the input port 614-1, the signal at the output port 614-2 is in-phase (0 deg phase shift), and the signal at the output port 614-3 is phase shifted by −90 deg.

Return to the quadrature splitter 612. The output port 612-3 is electrically connected to the input port 616-1 of the −90 deg phase shifter 616. With respect to the signal at the input port 616-1, the signal at the output port 616-2 is phase shifted by −90 deg (net phase shift of −180 deg with respect to the signal at the input port 612-1 of the quadrature splitter 612). The output port 616-2 is electrically connected to the input port 618-1 of the quadrature splitter 618. With respect to the signal at the input port 618-1, the signal at the output port 618-2 is in-phase (0 deg phase shift), and the signal at the output port 618-3 is phase shifted by −90 deg.

Consequently, the output signals at port 614-2, port 614-3, port 618-2, and port 618-3 have net phase shifts of 0 deg, −90 deg, −180 deg, and −270 deg, respectively. These four ports are electrically connected to the LF exciter pin 540-1, the LF exciter pin 540-2, the LF exciter pin 540-3, and the LF exciter pin 540-4, respectively. Circularly-polarized radiation is therefore excited.

Figure 9C:
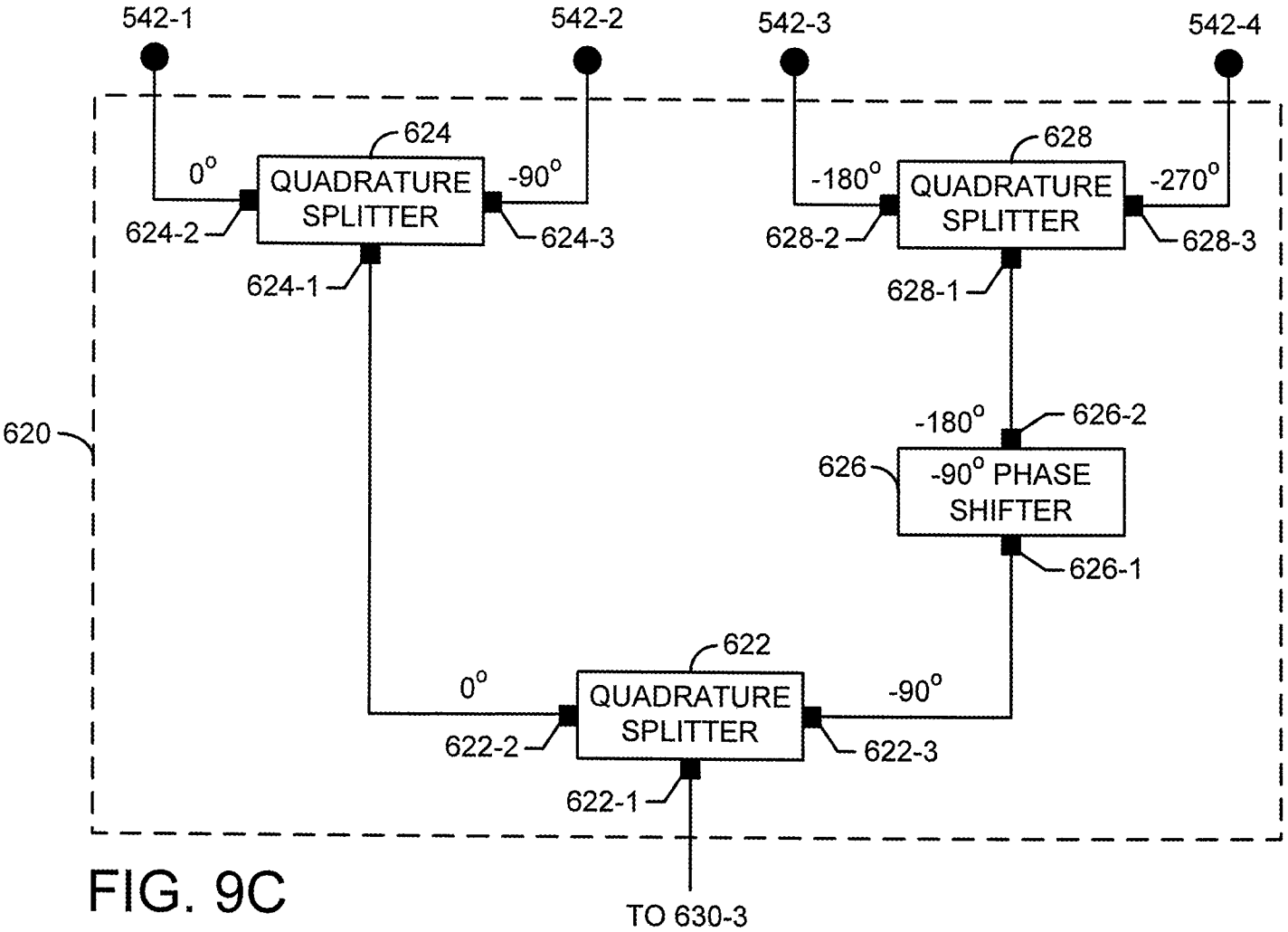

The HF excitation system 610 is shown schematically in FIG. 9C and described in the transmit mode. Refer to the quadrature splitter 622. The input port 622-1 is electrically connected to the port 630-3 of the LNA 630. With respect to the signal at the input port 622-1, the signal at the output port 622-2 is in-phase (0 deg phase shift), and the signal at the output port 622-3 is phase shifted by −90 deg. The output port 622-2 is electrically connected to the input port 624-1 of the quadrature splitter 624. With respect to the signal at the input port 624-1, the signal at the output port 624-2 is in-phase (0 deg phase shift), and the signal at the output port 624-3 is phase shifted by −90 deg.

Return to the quadrature splitter 622. The output port 622-3 is electrically connected to the input port 626-1 of the −90 deg phase shifter 626. With respect to the signal at the input port 626-1, the signal at the output port 626-2 is phase shifted by −90 deg (net phase shift of −180 deg with respect to the signal at the input port 622-1 of the quadrature splitter 622). The output port 626-2 is electrically connected to the input port 628-1 of the quadrature splitter 628. With respect to the signal at the input port 628-1, the signal at the output port 628-2 is in-phase (0 deg phase shift), and the signal at the output port 628-3 is phase shifted by −90 deg.

Consequently, the output signals at port 624-2, port 624-3, port 628-2, and port 628-3 have net phase shifts of 0 deg, −90 deg, −180 deg, and −270 deg, respectively. These four ports are electrically connected to the HF exciter pin 542-1, the HF exciter pin 542-2, the HF exciter pin 542-3, and the HF exciter pin 542-4, respectively. Circularly-polarized radiation is therefore excited.

In an embodiment, the LF excitation system 610 is fabricated on the bottom side 524B of the PCB 524; and the LNA 630 is also mounted on the bottom side 524B, The HF excitation system 620 is fabricated on the top side 528T of the PCB 528. A signal cable (not shown) electrically connects the HF excitation system 620 to the LNA 630.

Figure 8A:
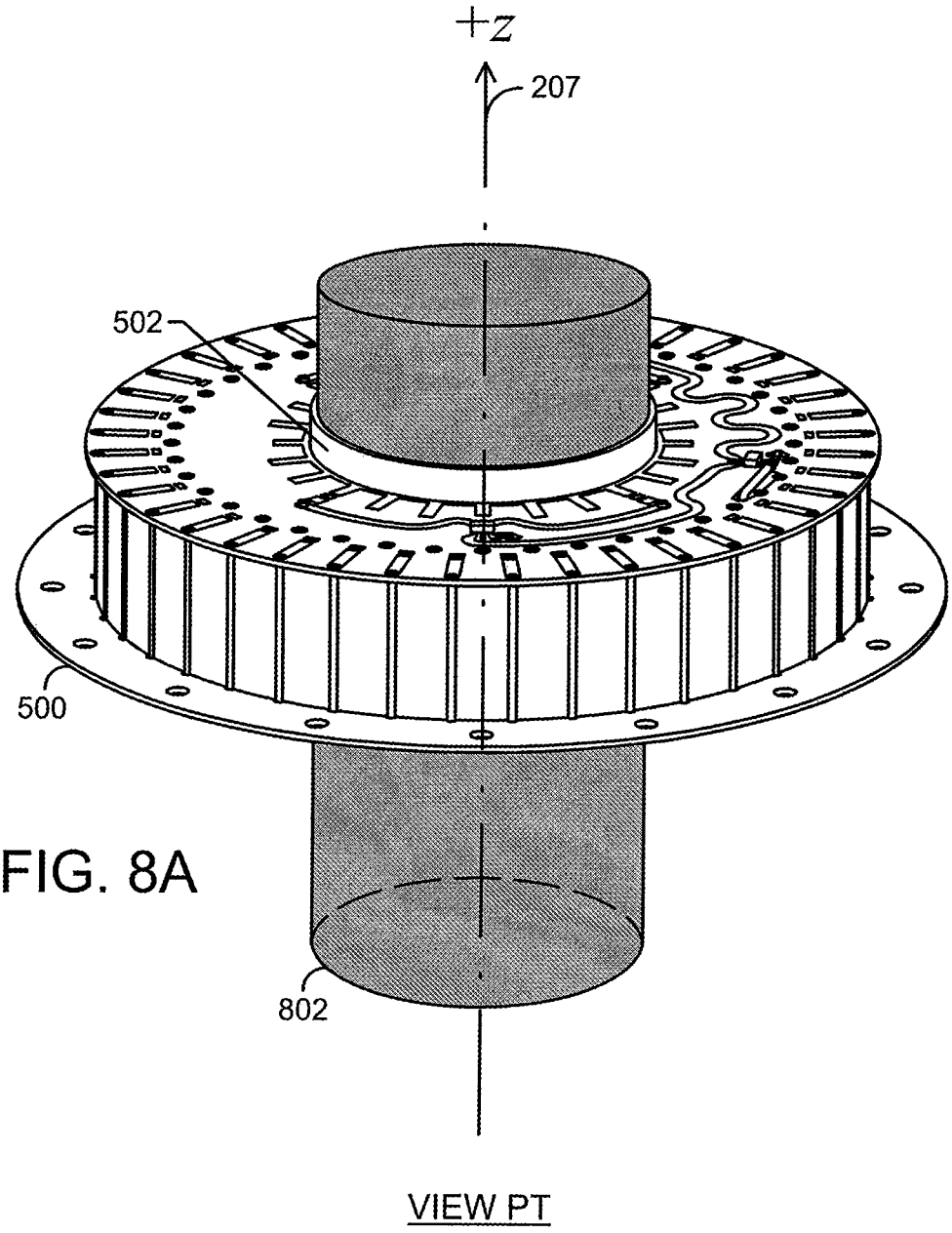
FIG. 8A shows an embodiment of an antenna system mounted on a short post.
Figure 8B:
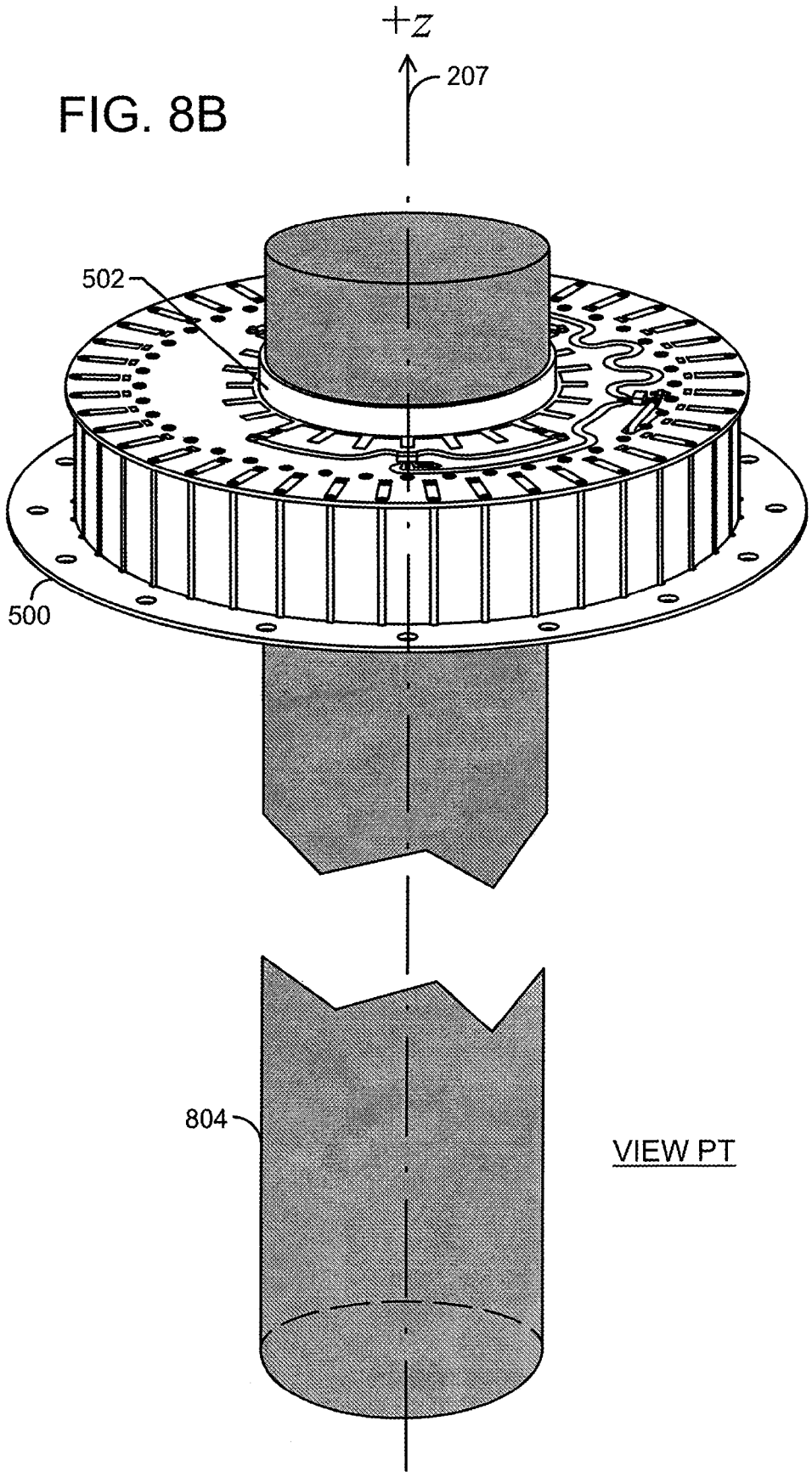
FIG. 8B shows an embodiment of an antenna system mounted on a long pole.

FIG. 8A shows an embodiment in which the antenna system 500 is mounted on a short post 802, which is inserted through the cylindrical tube 502. The antenna system 500 can be attached to the post 802 with, for example, adhesive, clamps, or brackets (not shown). FIG. 8B shows an embodiment in which the antenna system 500 is mounted on a long pole 804, which is inserted through the cylindrical tube 502. The antenna system 500 can be attached to the pole 804 with, for example, adhesive, clamps, or brackets (not shown). Assuming a reference operational wavelength $\lambda_{ref}$ of 258 mm, the inner diameter of the cylindrical tube 502 can range from about 38 mm to about 102 mm. Assuming a reference operational wavelength $\lambda_{ref}$ of 187 mm, the inner diameter of the cylindrical tube 502 can range from about 28 mm to about 75 mm.

Figure 10A:
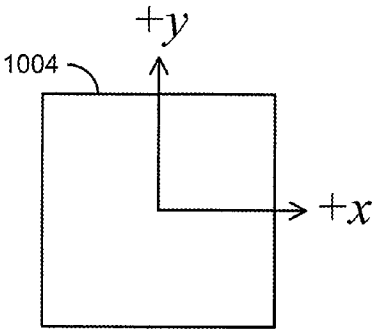
FIG. 10A-FIG. 10F show antenna lateral cross-sectional geometries that are regular polygons.
Figure 10B:
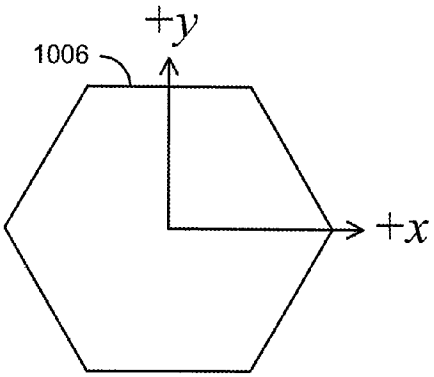
Figure 10C:
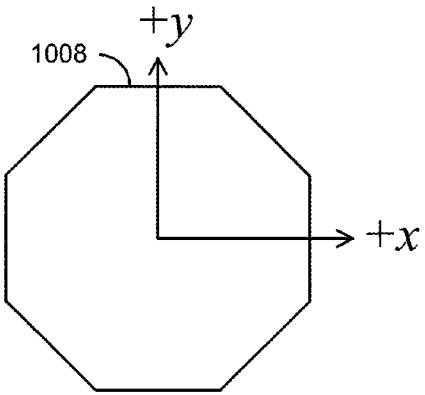
Figure 10D:
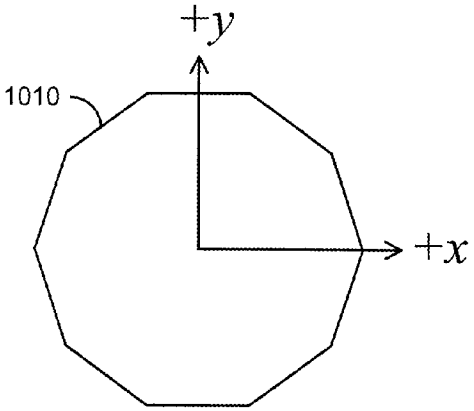
Figure 10E:
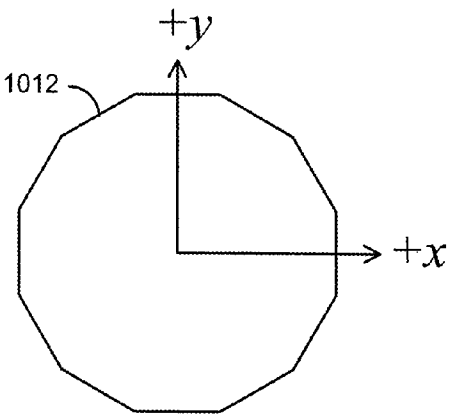
Figure 10F:
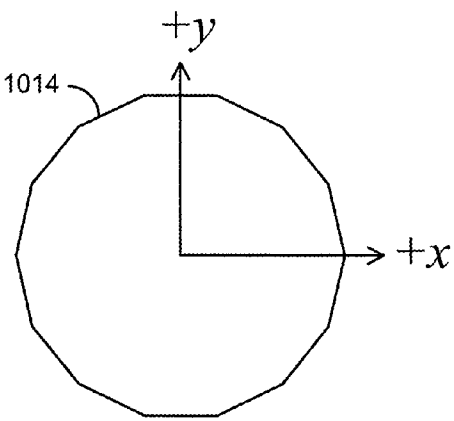

In the embodiments described above, the antennas have an overall approximately cylindrical geometry: the center tube has the geometry of a cylindrical tube, and the LF radiator and the HF radiator have the geometry of a circular annulus. In other embodiments, the cross-sectional geometry of the antenna (orthogonal to the longitudinal axis of the antenna) is non-circular. For example, the cross-sectional geometry of the center tube (inner wall and outer wall), LF radiator, HF radiator, and other components can be an n-sided regular polygon, where n is an integer greater than or equal to 4. FIG. 10A shows a 4-sided regular polygon 1004; FIG. 10B shows a 6-sided regular polygon 1006; FIG. 10C shows an 8-sided regular polygon 1008; FIG. 10D shows a 10-sided regular polygon 1010; FIG. 10E shows a 12-sided regular polygon 1012; and FIG. 10F shows a 14-sided regular polygon 1014. For a regular polygon, the size can be characterized by a characteristic lateral dimension. For example, if the polygon is inscribed in a circle, the characteristic lateral dimension can be the diameter of the circle.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. An antenna comprising:

a conductive cylindrical tube having:
- a longitudinal axis;
- an inner surface having a first inner diameter; and
- an outer surface having a first outer diameter;

a ground plane, wherein:
- the ground plane comprises a first annulus having:
  - a first circular inner periphery having a second inner diameter; and
  - a first circular outer periphery having a second outer diameter;
- the ground plane is orthogonal to the longitudinal axis; and
- the first circular inner periphery is electrically connected to the outer surface;

a low-frequency radiator, wherein:
- the low-frequency radiator comprises a second annulus having:
  - a second circular inner periphery having a third inner diameter; and
  - a second circular outer periphery having a third outer diameter;
- the low-frequency radiator is orthogonal to the longitudinal axis;
- the second circular inner periphery is electrically connected to the outer surface;
- the low-frequency radiator is spaced apart from the ground plane; and
- a low-frequency radiating gap is configured between the second circular outer periphery and the ground plane;

a high-frequency radiator, wherein:

the high-frequency radiator comprises a third annulus having:

a third circular inner periphery having a fourth inner diameter; and a third circular outer periphery having a fourth outer diameter;

the high-frequency radiator is orthogonal to the longitudinal axis;

the high-frequency radiator is spaced apart from the low-frequency radiator such that the low-frequency radiator is disposed between the high-frequency radiator and the ground plane;

the third circular outer periphery is electrically connected to the low-frequency radiator; and a high-frequency radiating gap is configured between the third circular inner periphery and the outer surface; and a set of high-frequency capacitive elements, wherein:

the set of high-frequency capacitive elements is spaced apart from the high-frequency radiator;

each high-frequency capacitive element in the set of high-frequency capacitive elements has a first end and a second end; and the first end of each high-frequency capacitive element is electrically connected to the outer surface.

2. The antenna of claim 1, further comprising a set of parasitic elements, wherein:

the set of parasitic elements is disposed around the low-frequency radiator and the high-frequency radiator;

each parasitic element in the set of parasitic elements has a first end and a second end; and the first end of each parasitic element is electrically connected to the ground plane.

3. The antenna of claim 1, further comprising a set of low-frequency capacitive elements, wherein:

the set of low-frequency capacitive elements is disposed between the low-frequency radiator and the ground plane;

each low-frequency capacitive element in the set of low-frequency capacitive elements has a first end and a second end; and the first end of each low-frequency capacitive element is electrically connected to the second circular outer periphery.

4. The antenna of claim 1, wherein:

the low-frequency radiator is configured to operate with circularly-polarized electromagnetic radiation having a frequency greater than or equal to a first specified frequency and less than or equal to a second specified frequency, wherein the second specified frequency is greater than the first specified frequency; and the high-frequency radiator is configured to operate with circularly-polarized electromagnetic radiation having a frequency greater than or equal to a third specified frequency and less than or equal to a fourth specified frequency, wherein the third specified frequency is greater than the second specified frequency, and the fourth specified frequency is greater than the third specified frequency.

5. The antenna of claim 4, wherein a reference operational wavelength is selected such that the reference operational wavelength is greater than or equal to a first specified wavelength and less than or equal to a second specified wavelength, wherein the first specified wavelength corresponds to the fourth specified frequency and the second specified wavelength corresponds to the first specified frequency.

6. The antenna of claim 5, wherein the first outer diameter has a value from about 0.15 times the reference operational wavelength to about 0.4 times the reference operational wavelength.

7. The antenna of claim 4, wherein:

the first specified frequency is about 1165 MHz;

the second specified frequency is about 1300 MHz;

the third specified frequency is about 1525 MHz; and the fourth specified frequency is about 1605 MHz.

8. The antenna of claim 7, wherein a reference operational wavelength is selected such that the reference operational wavelength is greater than or equal to about 187 mm and less than or equal to about 258 mm.

9. The antenna of claim 8, wherein the first outer diameter has a value from about 28 mm to about 103 mm.

10. The antenna of claim 9, wherein the first inner diameter has a value from about 27 mm to about 102 mm.

11. The antenna of claim 1, further comprising:

a set of four low-frequency excitation pins electrically connected to the low-frequency radiator, the set of four low-frequency excitation pins comprising:

a first low-frequency excitation pin configured to excite a first low-frequency electromagnetic signal having a first phase;

a second low-frequency excitation pin configured to excite a second low-frequency electromagnetic signal having a second phase, wherein a difference between the second phase and the first phase is about 90 degrees;

a third low-frequency excitation pin configured to excite a third low-frequency electromagnetic signal having a third phase, wherein a difference between the third phase and the first phase is about 180 degrees; and a fourth low-frequency excitation pin configured to excite a fourth low-frequency electromagnetic signal having a fourth phase, wherein a difference between the second phase and the first phase is about 270 degrees; and a set of four high-frequency excitation pins electrically connected to the high-frequency radiator, the set of four high-frequency excitation pins comprising:

a first high-frequency excitation pin configured to excite a first high-frequency electromagnetic signal having a fifth phase;

a second high-frequency excitation pin configured to excite a second high-frequency electromagnetic signal having a sixth phase, wherein a difference between the sixth phase and the fifth phase is about 90 degrees;

a third high-frequency excitation pin configured to excite a third high-frequency electromagnetic signal having a seventh phase, wherein a difference between the seventh phase and the fifth phase is about 180 degrees; and a fourth high-frequency excitation pin configured to excite a fourth high-frequency electromagnetic signal having an eighth phase, wherein a difference between the eighth phase and the first phase is about 270 degrees.

12. The antenna of claim 1, further comprising:

a first printed circuit board having a first top side and a first bottom side, wherein:

the ground plane is fabricated on the first top side; and a low-frequency excitation system is fabricated on the first bottom side; and a second printed circuit board having a second top side and a second bottom side, wherein:

the high-frequency radiator is fabricated on the second bottom side;

the set of high-frequency capacitive elements is fabricated on the second top side; and a high-frequency excitation system is fabricated on the second top side.

13. The antenna of claim 12, further comprising a low-noise amplifier operably coupled to the low-frequency excitation system and the high-frequency excitation system.

14. The antenna of claim 13, wherein the low-noise amplifier is disposed on the first bottom side.

* * * * *